US009225058B2

(12) United States Patent
DeVries et al.

(10) Patent No.: US 9,225,058 B2
(45) Date of Patent: Dec. 29, 2015

(54) FLEX PCB FOLDED ANTENNA

(71) Applicant: BlackBerry Limited, Waterloo (CA)

(72) Inventors: Christopher Andrew DeVries, Waterloo (CA); Houssam Kanj, Waterloo (CA)

(73) Assignee: BlackBerry Limited, Waterloo, Ontario (CA)

( * ) Notice: Subject to any disclaimer, the term of this patent is extended or adjusted under 35 U.S.C. 154(b) by 294 days.

(21) Appl. No.: 13/834,714

(22) Filed: Mar. 15, 2013

(65) Prior Publication Data

US 2014/0266973 A1 Sep. 18, 2014

(51) Int. Cl.

| | |
|---|---|
| ***H01Q 1/38*** | (2006.01) |
| ***H01Q 21/06*** | (2006.01) |
| ***H01P 11/00*** | (2006.01) |
| ***H01Q 21/24*** | (2006.01) |

(52) U.S. Cl.

CPC ..... *H01Q 1/38* (2013.01); *H01P 11/001* (2013.01); *H01Q 21/067* (2013.01); *H01Q 21/24* (2013.01); *Y10T 29/49018* (2015.01)

(58) Field of Classification Search

CPC ... H01Q 21/06; H01Q 21/061; H01Q 21/067; H01Q 21/24; H01Q 1/38

USPC ..... 343/700 MS, 893

See application file for complete search history.

(56) References Cited

U.S. PATENT DOCUMENTS

| | | | | |
|---|---|---|---|---|
| 5,030,961 | A | 7/1991 | Tsao | |
| 6,104,349 | A * | 8/2000 | Cohen | 343/702 |
| 6,462,412 | B2 | 10/2002 | Kamei et al. | |
| 7,042,420 | B2 | 5/2006 | Ebling et al. | |
| 7,057,563 | B2 * | 6/2006 | Cox et al. | 343/700 MS |
| 7,321,336 | B2 | 1/2008 | Phillips et al. | |
| 8,022,887 | B1 | 9/2011 | Zarnaghi | |
| 2003/0151556 | A1 | 8/2003 | Cohen | |
| 2010/0171673 | A1 | 7/2010 | Guy et al. | |
| 2010/0328171 | A1 | 12/2010 | Mak et al. | |
| 2012/0235881 | A1 | 9/2012 | Pan et al. | |

FOREIGN PATENT DOCUMENTS

| | | | | |
|---|---|---|---|---|
| EP | 1686651 A2 | | 8/2006 | |
| GB | 2 397 697 A | * | 7/2004 | H01Q 1/38 |
| GB | 2487391 A | * | 7/2012 | H01Q 19/04 |

OTHER PUBLICATIONS

Extended European Search Report for EP Application No. 14159924.1-1812, dated Jun. 30, 2014, pp. 1-7.

(Continued)

*Primary Examiner* — Hoang V Nguyen

(74) *Attorney, Agent, or Firm* — Conley Rose, P.C.; J. Robert Brown, Jr.

(57) ABSTRACT

Embodiments are directed to a flexible substrate, and an end-fire antenna array mounted on the flexible substrate, wherein the flexible substrate is configured to be oriented so that array gain is oriented in a direction perpendicular to a plane of the flexible substrate. Embodiments are directed to mounting an end-fire antenna array on a flexible substrate, and orienting the flexible substrate so that array gain is oriented in a direction perpendicular to a plane of the flexible substrate.

21 Claims, 20 Drawing Sheets

(56) References Cited

OTHER PUBLICATIONS

Lamminen, Antti, et al.; "Wideband Millimetre Wave End-Fire Antenna and Array for Wireless Short-Range Applications"; Antennas and Propagation (EuCAP), 2010 Proceedings of the Fourth European Conference; p. 1-5; Apr. 12-16, 2010.

Gilbert, Jeffrey M., et al.; "Wireless Panel Architecture using Lossless Uncompressed 60 GHz Transmissions"; SID Digest; 2009; 4 pages.

* cited by examiner

832

852

872

FLEX PCB FOLDED ANTENNA

BACKGROUND

Recently, spectrum around 60 GHz has attracted, e.g., industrial companies and research to explore its potential in wireless communications, short-distance data transfer, and other applications. Phased arrays of antennas may be used to increase antenna gain. A separate phase control may be used to steer the pattern of the antenna to obtain maximum gain.

With the use of planar printed circuit board (PCB) technology, or any other planar, multi-layer substrate technology, antennas are limited in their ability to steer the pattern of the antenna in certain dimensions or in certain directions. For example, using a patch array implemented on a PCB, the radiation pattern emerging from the patch array will be substantially perpendicular to the plane of the PCB. Using an end-fire array, the emerging radiation pattern will be substantially parallel to the plane of the PCB (e.g., the emerging radiation pattern will "fire off the edge" of the PCB).

BRIEF DESCRIPTION OF THE DRAWINGS

The present disclosure may be understood, and its numerous objects, features and advantages obtained, when the following detailed description is considered in conjunction with the following drawings, in which.

DETAILED DESCRIPTION

Figure 1:
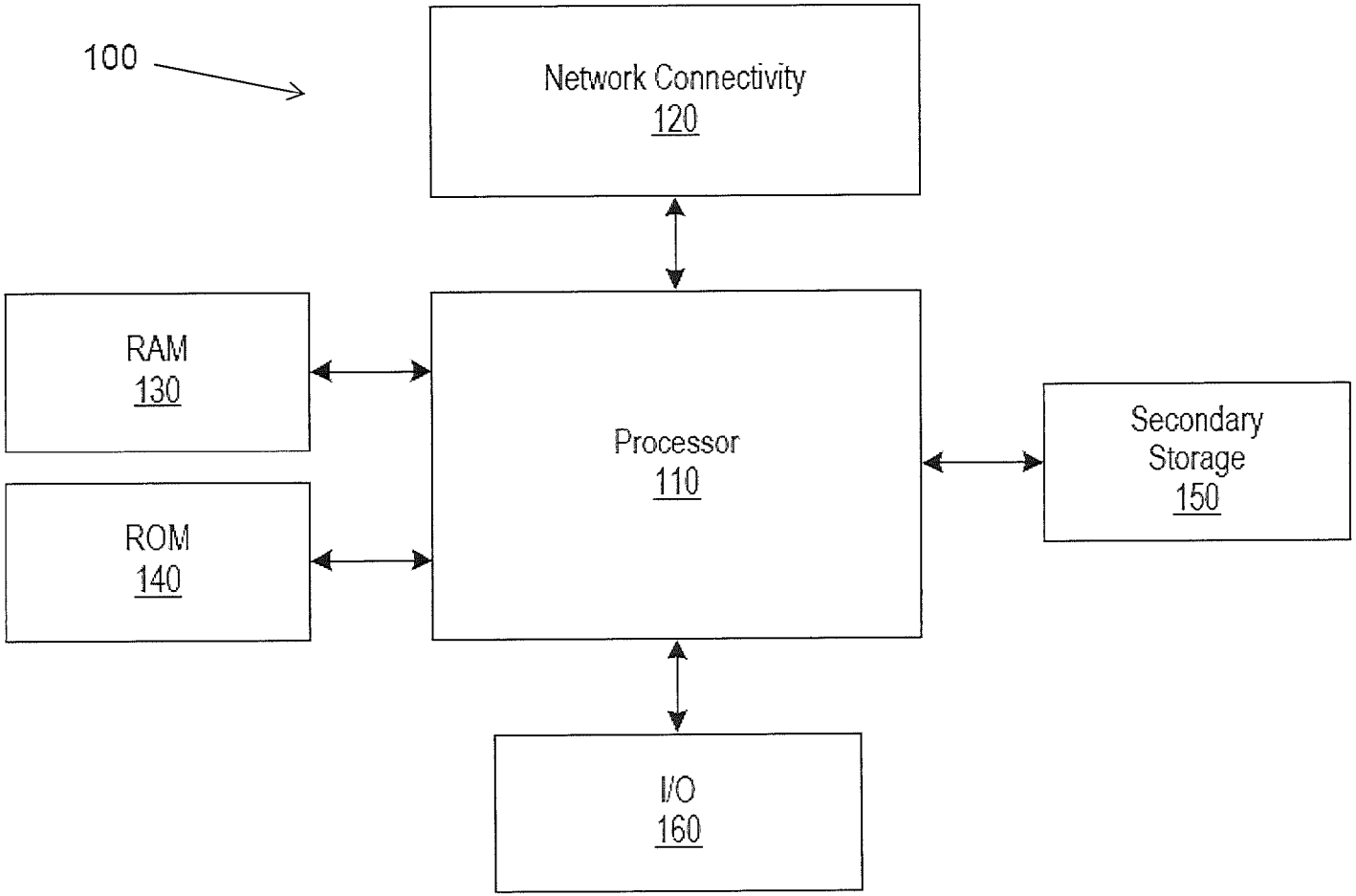
FIG. 1 depicts a system in which the present disclosure may be implemented.

The present disclosure is directed in general to communications systems and methods for operating same.

Embodiments are directed to a device comprising a flexible substrate, and an end-fire antenna array mounted on the flexible substrate, wherein the flexible substrate is configured to be oriented so that array gain is oriented in a direction perpendicular to a plane of the flexible substrate.

Embodiments are directed to a method comprising mounting an end-fire antenna array on a flexible substrate, and orienting the flexible substrate so that array gain is oriented in a direction perpendicular to a plane of the flexible substrate.

Embodiments are directed to an antenna array comprising a foldable, flex substrate having a first side, a second side, and a bent connection connecting the first side and the second side, a first plurality of end-fire antenna mounted to the first side, a second plurality of end-fire antenna mounted to the second side, and a feed, at least on the bent connection, connected to both the first and second pluralities of end-fire antenna.

Various illustrative embodiments of the present disclosure will now be described in detail with reference to the accompanying figures. While various details are set forth in the following description, it will be appreciated that the present disclosure may be practiced without these specific details, and that numerous implementation-specific decisions may be made to the disclosure described herein to achieve specific goals, such as compliance with process technology or design-related constraints, which will vary from one implementation to another. While such a development effort might be complex and time-consuming, it would nevertheless be a routine undertaking for those of skill in the art having the benefit of this disclosure. For example, selected aspects are shown in block diagram and flowchart form, rather than in detail, in order to avoid limiting or obscuring the present disclosure. In addition, some portions of the detailed descriptions provided herein are presented in terms of algorithms or operations on data within a computer memory. Such descriptions and representations are used by those skilled in the art to describe and convey the substance of their work to others skilled in the art.

As used herein, the terms "component," "system" and the like are intended to refer to a computer-related entity, either hardware, software, a combination of hardware and software, or software in execution. For example, a component may be, but is not limited to being, a processor, a process running on a processor, an object, an executable instruction sequence, a thread of execution, a program, or a computer. In an example, a component may be, but is not limited to being, circuitry, a process running on circuitry, an object, an executable instruction sequence, a thread of execution, a program, or a computing device. By way of illustration, both an application miming on a computer and the computer itself can be a component. One or more components may reside within a process or thread of execution and a component may be localized on one computer or distributed between two or more computers.

As likewise used herein, the term "node" broadly refers to a connection point, such as a redistribution point or a communication endpoint, of a communication environment, such as a network. Accordingly, such nodes refer to an active electronic device capable of sending, receiving, or forwarding information over a communications channel. Examples of such nodes include data circuit-terminating equipment (DCE), such as a modem, hub, bridge or switch, and data terminal equipment (DTE), such as a handset, a printer or a host computer (e.g., a router, workstation or server). Examples of local area network (LAN) or wide area network (WAN) nodes include computers, packet switches, cable modems, Data Subscriber Line (DSL) modems, and wireless LAN (WLAN) access points. Examples of Internet or Intranet nodes include host computers identified by an Internet Protocol (IP) address, bridges and WLAN access points. Likewise, examples of nodes in cellular communication include base stations, relays, base station controllers, radio network controllers, home location registers (HLR), visited location registers (VLR), Gateway GPRS Support Nodes (GGSN), Serving GPRS Support Nodes (SGSN), Serving Gateways (S-GW), and Packet Data Network Gateways (PDN-GW).

Other examples of nodes include client nodes, server nodes, peer nodes and access nodes. As used herein, a client node may refer to wireless devices such as mobile telephones, smart phones, personal digital assistants (PDAs), handheld devices, portable computers, tablet computers, and similar devices or other user equipment (UE) that has telecommunications capabilities. Such client nodes may likewise refer to a mobile, wireless device, or alternatively, to devices that have similar capabilities that are not generally transportable, such as desktop computers, set-top boxes, or sensors. A network node, as used herein, generally includes all nodes with the exception of client nodes, server nodes and access nodes. Likewise, a server node, as used herein, refers to an information processing device (e.g., a host computer), or series of information processing devices, that perform information processing requests submitted by other nodes. As likewise used herein, a peer node may sometimes serve as client node, and at other times, a server node. In a peer-to-peer or overlay network, a node that actively routes data for other networked devices as well as itself may be referred to as a supernode.

An access node, as used herein, refers to a node that provides a client node access to a communication environment. Examples of access nodes include cellular network base stations and wireless broadband (e.g., WiFi, WiMAX, etc.) access points, which provide corresponding cell and WLAN coverage areas. As used herein, a macrocell is used to generally describe a traditional cellular network cell coverage area. Such macrocells are typically found in rural areas, along highways, or in less populated areas. As likewise used herein, a microcell refers to a cellular network cell with a smaller coverage area than that of a macrocell. Such micro cells are typically used in a densely populated urban area. Likewise, as used herein, a picocell refers to a cellular network coverage area that is less than that of a microcell. An example of the coverage area of a picocell may be a large office, a shopping mall, or a train station. A femtocell, as used herein, currently refers to the smallest commonly accepted area of cellular network coverage. As an example, the coverage area of a femtocell is sufficient for homes or small offices.

In general, a coverage area of less than two kilometers typically corresponds to a microcell, 200 meters or less for a picocell, and on the order of 10 meters for a femtocell. The actual dimensions of the cell may depend on the radio frequency of operation, the radio propagation conditions and the density of communications traffic. As likewise used herein, a client node communicating with an access node associated with a macrocell is referred to as a "macrocell client." Likewise, a client node communicating with an access node associated with a microcell, picocell, or femtocell is respectively referred to as a "microcell client," "picocell client," or "femtocell client."

The term "article of manufacture" (or alternatively, "computer program product") as used herein is intended to encompass a computer program accessible from any computer-readable device or media, e.g., machine readable media. For example, computer readable media can include but are not limited to magnetic storage devices (e.g., hard disk, floppy disk, magnetic strips, etc.), optical disks such as a compact disk (CD) or digital versatile disk (DVD), smart cards, and flash memory devices (e.g., card, stick, etc.). In an example, the machine readable media is in a tangible form capable of being detected by a machine, data being generated therefrom and such data being manipulated and transformed by a machine.

The word "exemplary" is used herein to mean serving as an example, instance, or illustration. Any aspect or design described herein as "exemplary" is not necessarily to be construed as preferred or advantageous over other aspects or designs. Those of skill in the art will recognize many modifications may be made to this configuration without departing from the scope, spirit or intent of the claimed subject matter. Furthermore, the disclosed subject matter may be implemented as a system, method, apparatus, or article of manufacture using standard programming and engineering techniques to produce software, firmware, hardware, or any combination thereof to control a computer or processor-based device to implement aspects detailed herein.

FIG. 1 illustrates an example of a system 100 suitable for implementing one or more embodiments disclosed herein. In various embodiments, the system 100 comprises a processor 110, which may be referred to as a central processor unit (CPU) or digital signal processor (DSP), network connectivity interfaces 120, random access memory (RAM) 130, read only memory (ROM) 140, secondary storage 150, and input/output (I/O) devices 160. In some embodiments, some of these components may not be present or may be combined in various combinations with one another or with other components not shown. These components may be located in a single physical entity or in more than one physical entity. Any actions described herein as being taken by the processor 110 might be taken by the processor 110 alone or by the processor 110 in conjunction with one or more components shown or not shown in FIG. 1.

The processor 110 executes instructions, codes, computer programs, or scripts that it might access from the network connectivity interfaces 120, RAM 130, or ROM 140. While only one processor 110 is shown, multiple processors may be present. Thus, while instructions may be discussed as being executed by a processor 110, the instructions may be executed simultaneously, serially, or otherwise by one or multiple processors 110 implemented as one or more CPU chips.

In various embodiments, the network connectivity interfaces 120 may take the form of modems, modem banks, Ethernet devices, universal serial bus (USB) interface devices, serial interfaces, token ring devices, fiber distributed data interface (FDDI) devices, wireless local area network (WLAN) devices (including radio, optical or infra-red signals), radio transceiver devices such as code division multiple access (CDMA) devices, global system for mobile communications (GSM) radio transceiver devices, long term evolution (LTE) radio transceiver devices, worldwide interoperability for microwave access (WiMAX) devices, and/or other well-known interfaces for connecting to networks, including Personal Area Networks (PANs) such as Bluetooth. These network connectivity interfaces 120 may enable the processor 110 to communicate with the Internet or one or more telecommunications networks or other networks from which the processor 110 might receive information or to which the processor 110 might output information.

The network connectivity interfaces 120 may also be capable of transmitting or receiving data wirelessly in the form of electromagnetic waves, such as radio frequency signals or microwave frequency signals. Information transmitted or received by the network connectivity interfaces 120 may include data that has been processed by the processor 110 or instructions that are to be executed by processor 110. The data may be ordered according to different sequences as may be desirable for either processing or generating the data or transmitting or receiving the data.

In various embodiments, the RAM 130 may be used to store volatile data and instructions that are executed by the processor 110. The ROM 140 shown in FIG. 1 may likewise be used to store instructions and data that is read during execution of the instructions. The secondary storage 150 is typically comprised of one or more disk drives, solid state drives, or tape drives and may be used for non-volatile storage of data or as an overflow data storage device if RAM 130 is not large enough to hold all working data. Secondary storage 150 may likewise be used to store programs that are loaded into RAM 130 when such programs are selected for execution. The I/O devices 160 may include liquid crystal displays (LCDs), Light Emitting Diode (LED) displays, Organic Light Emitting Diode (OLED) displays, projectors, televisions, touch screen displays, keyboards, keypads, switches, dials, mice, track balls, track pads, voice recognizers, card readers, paper tape readers, printers, video monitors, or other well-known input/output devices.

Figure 2:
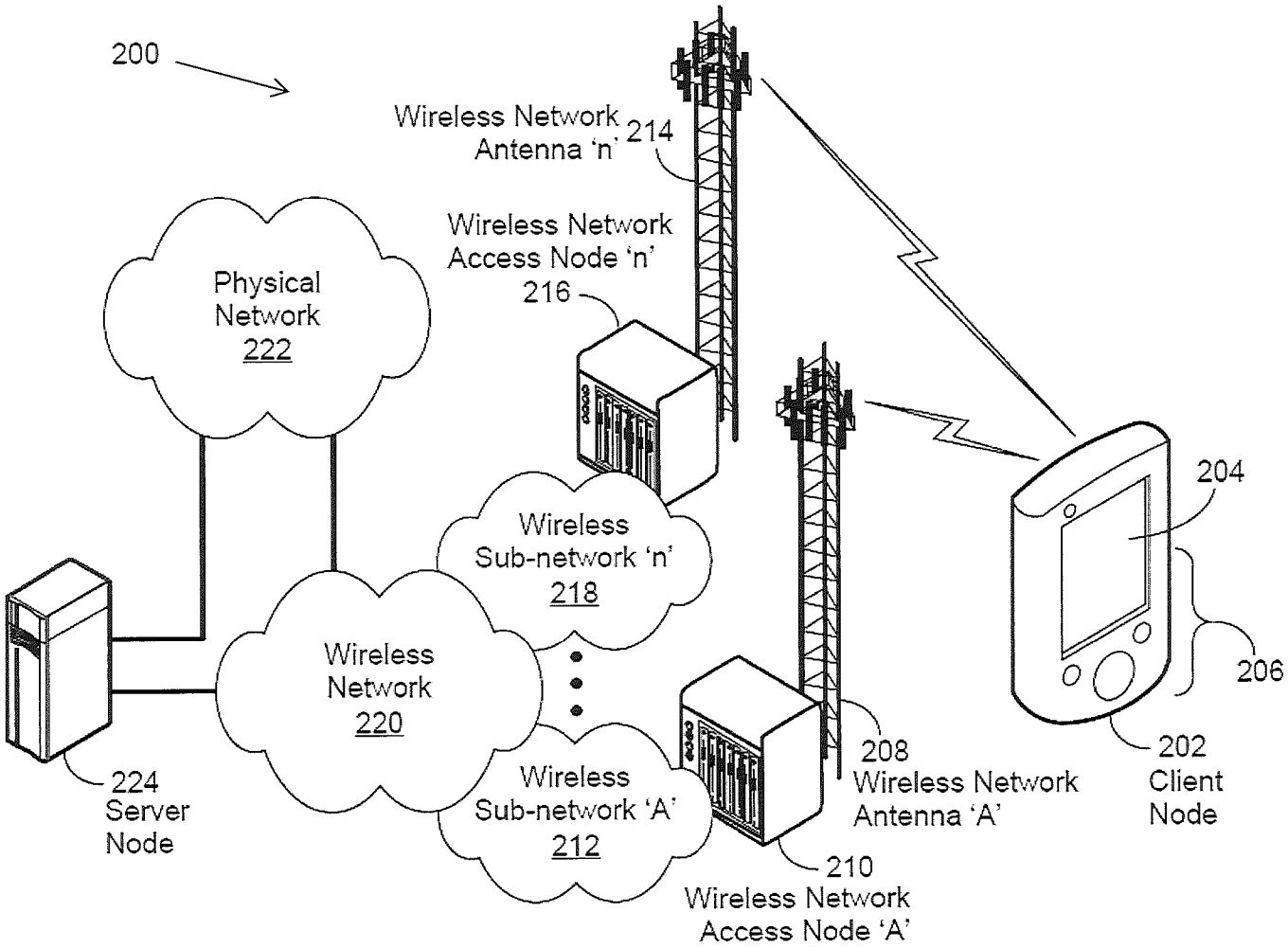
FIG. 2 shows a wireless-enabled communications environment including an embodiment of a client node.

FIG. 2 shows a wireless-enabled communications environment including an embodiment of a client node as implemented in an embodiment of the disclosure. Though illustrated as a mobile phone, the client node 202 may take various forms including a wireless handset, a pager, a smart phone, or a personal digital assistant (PDA). In various embodiments, the client node 202 may also comprise a portable computer, a tablet computer, a laptop computer, or any computing device operable to perform data communication operations. Many suitable devices combine some or all of these functions. In some embodiments, the client node 202 is not a general purpose computing device like a portable, laptop, or tablet computer, but rather is a special-purpose communications device such as a telecommunications device installed in a vehicle. The client node 202 may likewise be a device, include a device, or be included in a device that has similar capabilities but that is not transportable, such as a desktop computer, a set-top box, or a network node. In these and other embodiments, the client node 202 may support specialized activities such as gaming, inventory control, job control, task management functions, and so forth.

In various embodiments, the client node 202 includes a display 204. In these and other embodiments, the client node 202 may likewise include a touch-sensitive surface, a keyboard or other input keys 206 generally used for input by a user. The input keys 206 may likewise be a full or reduced alphanumeric keyboard such as QWERTY, DVORAK, AZERTY, and sequential keyboard types, or a traditional numeric keypad with alphabet letters associated with a telephone keypad. The input keys 206 may likewise include a trackwheel, an exit or escape key, a trackball, a track pad and other navigational or functional keys, which may be moved to different positions, e.g., inwardly depressed, to provide further input function. The client node 202 may likewise present options for the user to select, controls for the user to actuate, and cursors or other indicators for the user to direct.

The client node 202 may further accept data entry from the user, including numbers to dial or various parameter values for configuring the operation of the client node 202. The client node 202 may further execute one or more software or firmware applications in response to user commands. These applications may configure the client node 202 to perform various customized functions in response to user interaction. Additionally, the client node 202 may be programmed or configured over-the-air (OTA), for example from a wireless network access node 'A' 210 through 'n' 216 (e.g., a base station), a server node 224 (e.g., a host computer), or a peer client node 202.

Among the various applications executable by the client node 202 are a web browser, which enables the display 204 to display a web page. The web page may be obtained from a server node 224 through a wireless connection with a wireless network 220. As used herein, a wireless network 220 broadly refers to any network using at least one wireless connection between two of its nodes. The various applications may likewise be obtained from a peer client node 202 or other system over a connection to the wireless network 220 or any other wirelessly-enabled communication network or system.

In various embodiments, the wireless network 220 comprises a plurality of wireless sub-networks (e.g., cells with corresponding coverage areas) 'A' 212 through 'n' 218. As used herein, the wireless sub-networks 'A' 212 through 'n' 218 may variously comprise a mobile wireless access network or a fixed wireless access network. In these and other embodiments, the client node 202 transmits and receives communication signals, which are respectively communicated to and from the wireless network nodes 'A' 210 through 'n' 216 by wireless network antennas 'A' 208 through 'n' 214 (e.g., cell towers). In turn, the communication signals are used by the wireless network access nodes 'A' 210 through 'n' 216 to establish a wireless communication session with the client node 202. As used herein, the network access nodes 'A' 210 through 'n' 216 broadly refer to any access node of a wireless network. As shown in FIG. 2, the wireless network access nodes 'A' 210 through 'n' 216 are respectively coupled to wireless sub-networks 'A' 212 through 'n' 218, which are in turn connected to the wireless network 220.

In various embodiments, the wireless network 220 is coupled to a core network 222, e.g., a global computer network such as the Internet. Via the wireless network 220 and the core network 222, the client node 202 has access to information on various hosts, such as the server node 224. In these and other embodiments, the server node 224 may provide content that may be shown on the display 204 or used by the client node processor 110 for its operations. Alternatively, the client node 202 may access the wireless network 220 through a peer client node 202 acting as an intermediary, in a relay type or hop type of connection. As another alternative, the client node 202 may be tethered and obtain its data from a linked device that is connected to the wireless sub-network 212. Skilled practitioners of the art will recognize that many such embodiments are possible and the foregoing is not intended to limit the spirit, scope, or intention of the disclosure.

Figure 3:
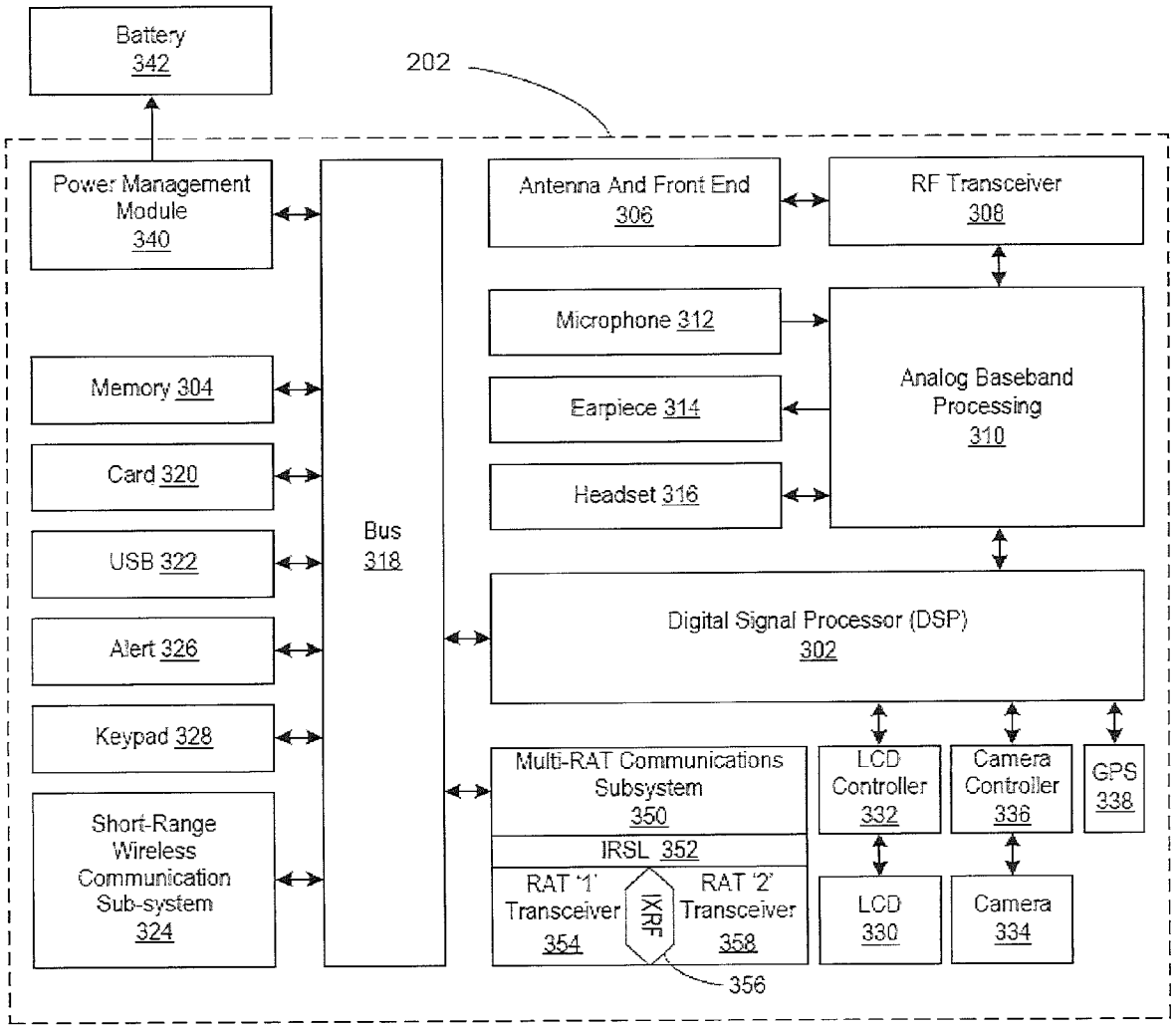
FIG. 3 is a simplified block diagram of a client node comprising a digital signal processor (DSP)
Figure 4A:
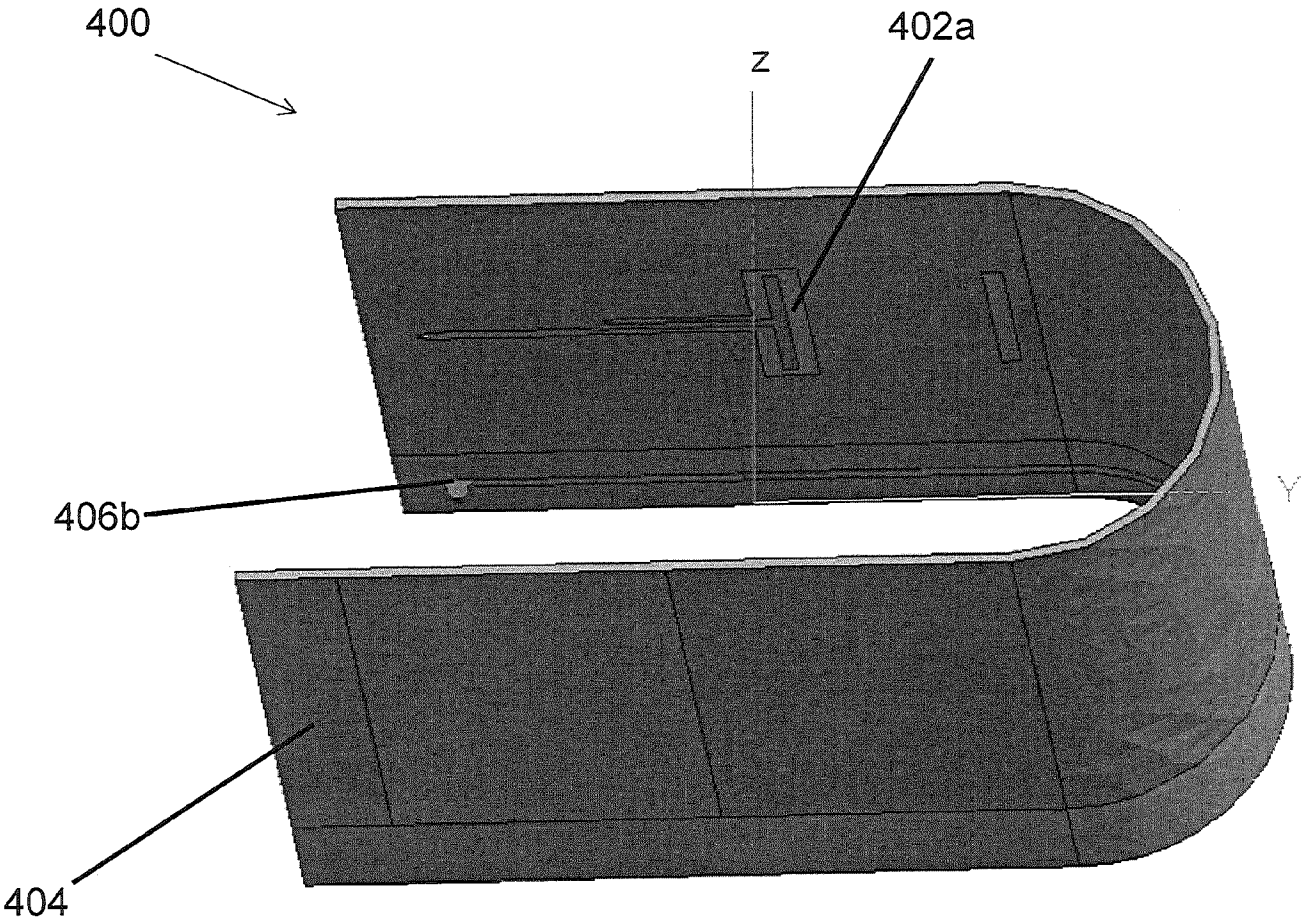
FIGS. 4A-4E illustrate a folded substrate incorporating an array of two antennas in accordance with one or more embodiments.
Figure 4B:
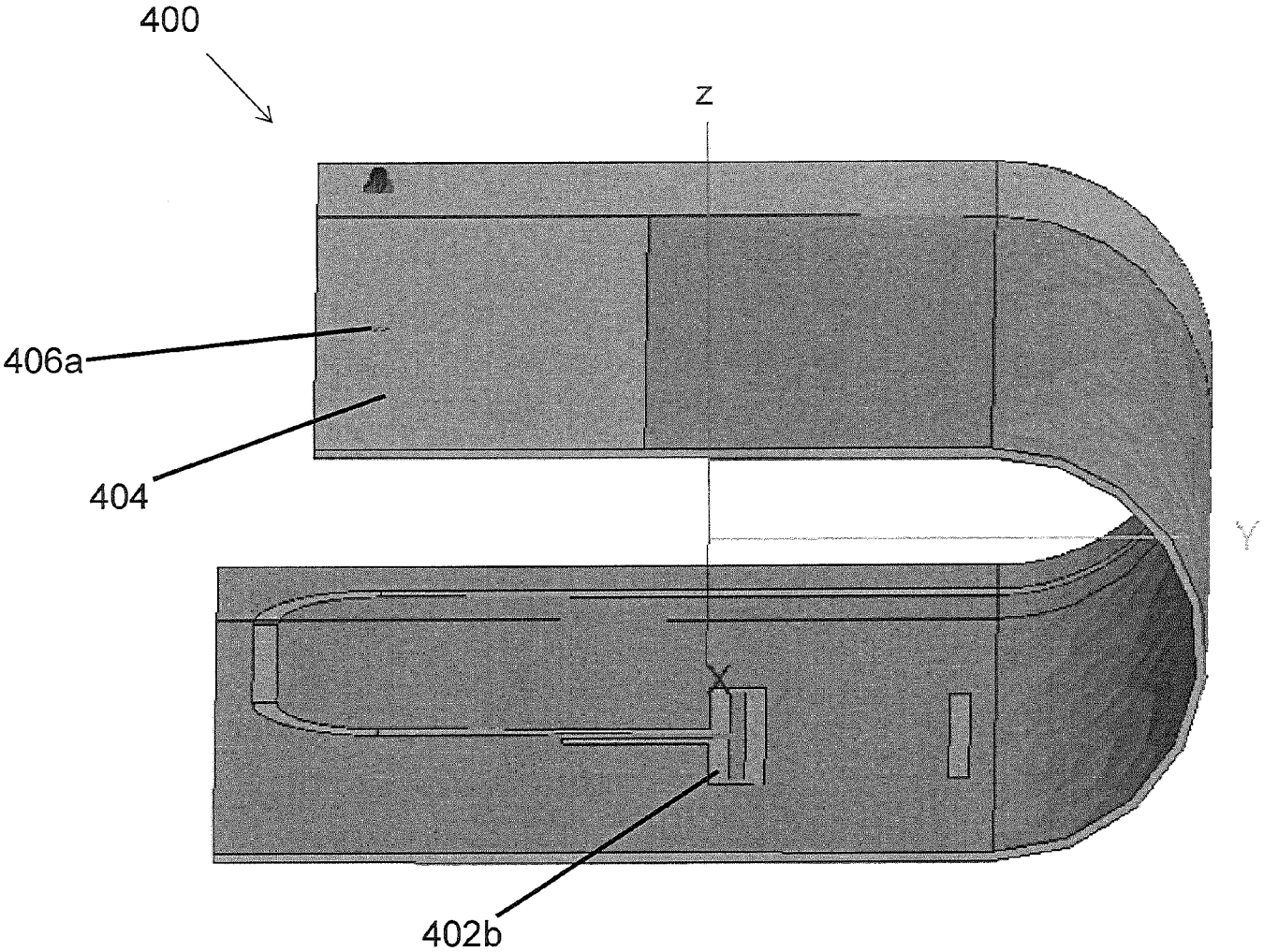
Figure 4C:
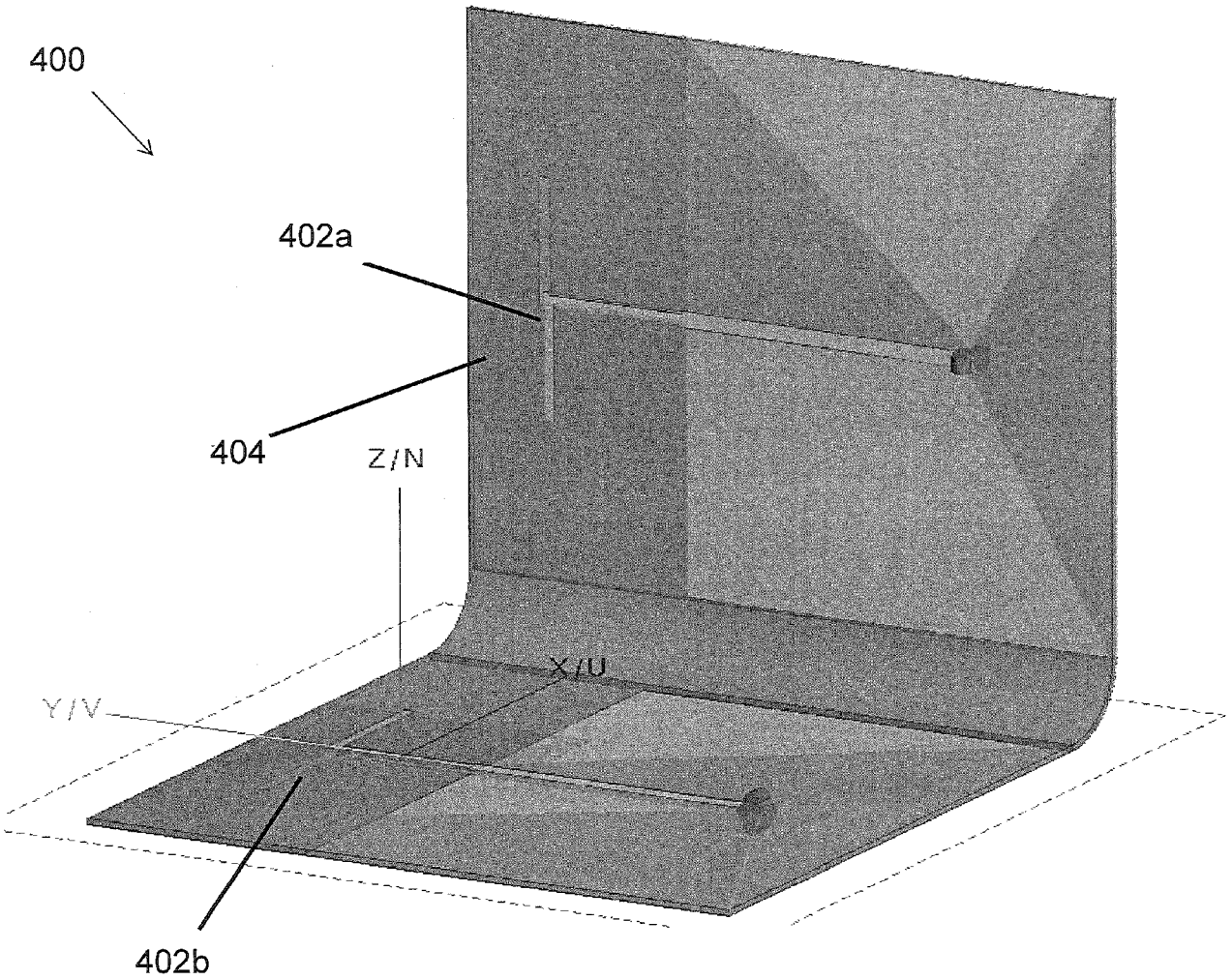
Figure 4D:
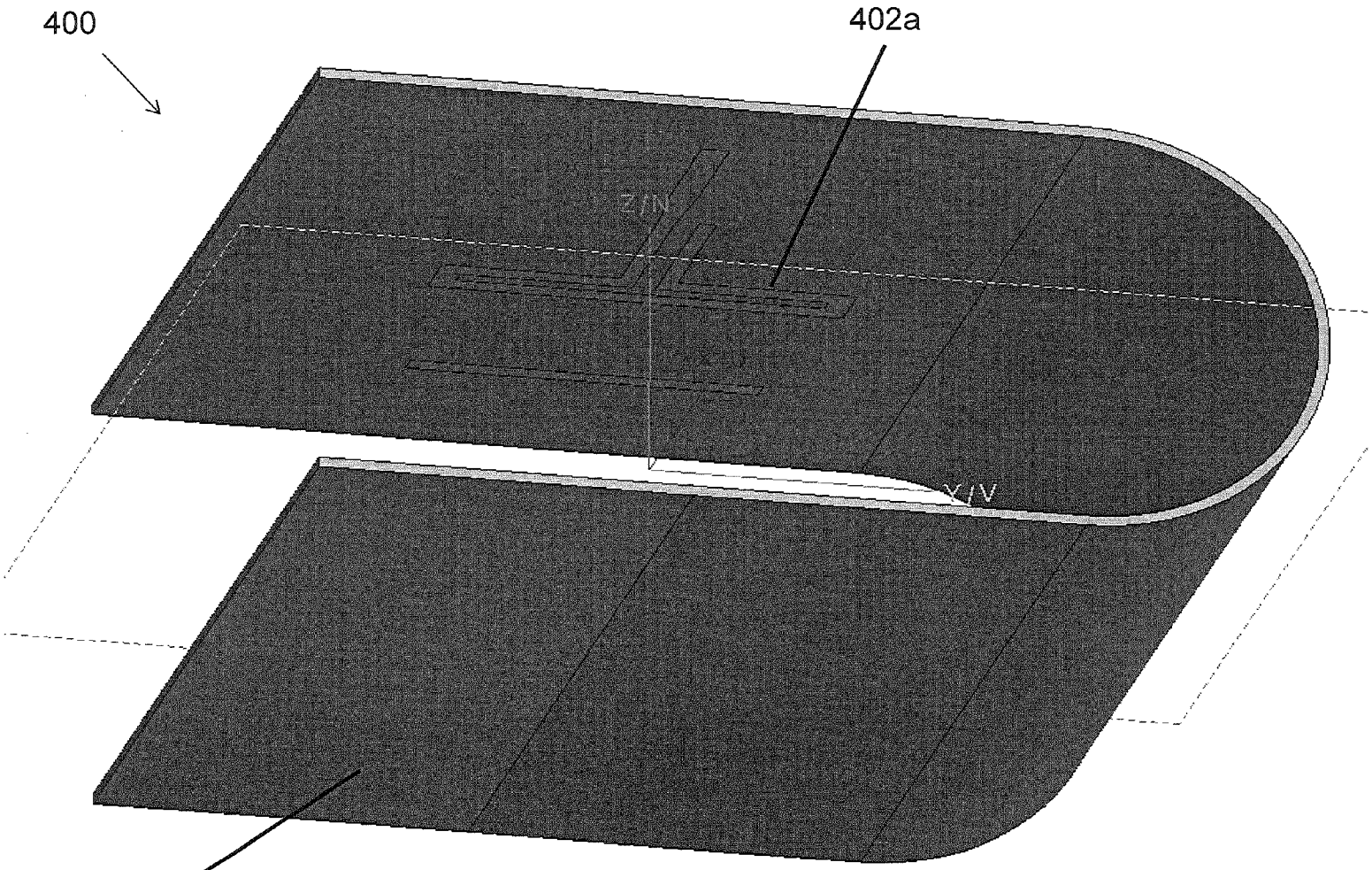
Figure 4E:
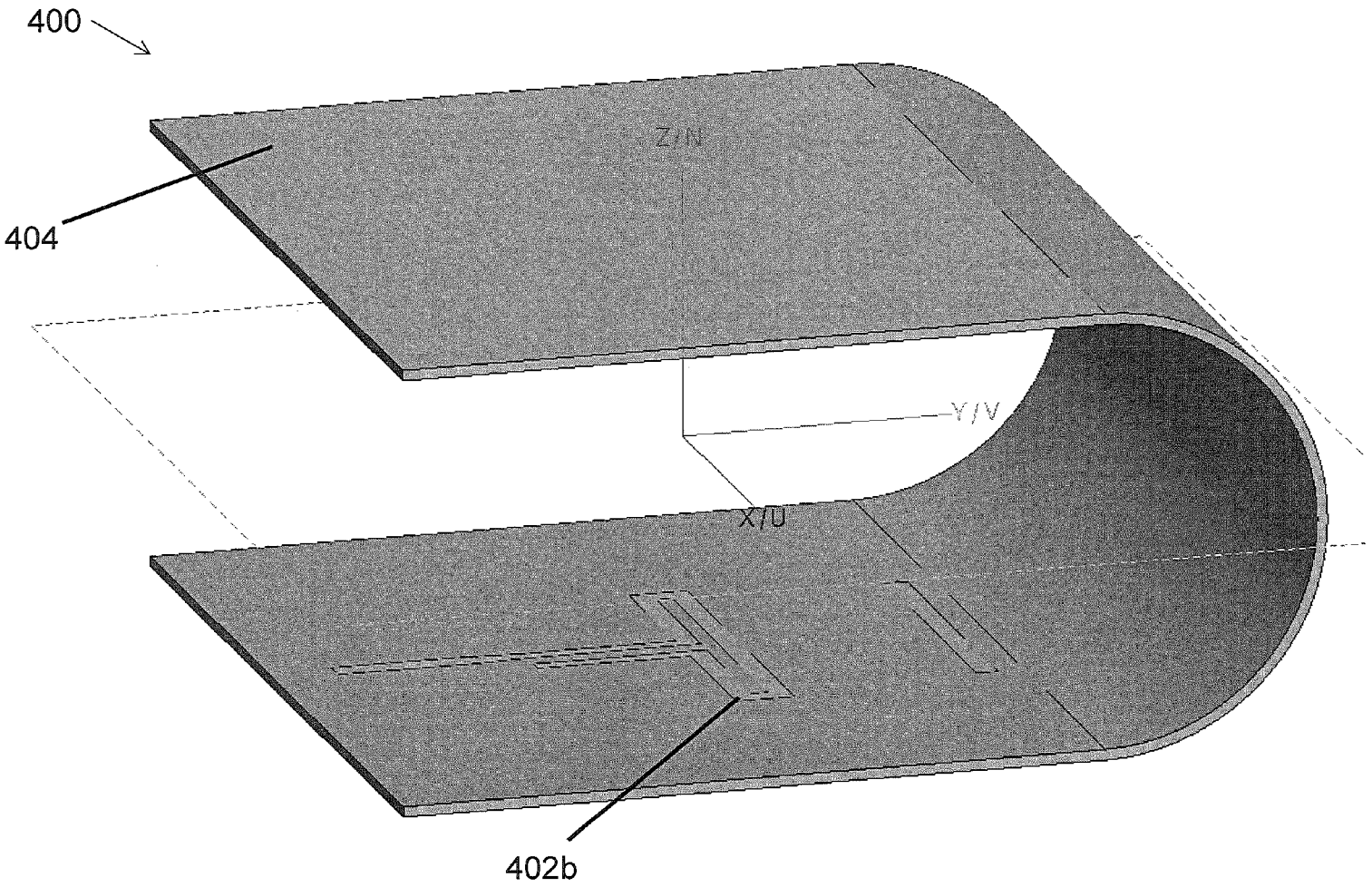

FIG. 3 depicts a block diagram of an exemplary client node as implemented with a digital signal processor (DSP) in accordance with an embodiment of the disclosure. While various components of a client node 202 are depicted, various embodiments of the client node 202 may include a subset of the listed components or additional components not listed. As shown in FIG. 3, the client node 202 includes a DSP 302 and a memory 304. As shown, the client node 202 may further include an antenna and front end unit 306, a radio frequency (RF) transceiver 308, an analog baseband processing unit 310, a microphone 312, an earpiece speaker 314, a headset port 316, a bus 318, such as a system bus or an input/output (I/O) interface bus, a removable memory card 320, a universal serial bus (USB) port 322, a short range wireless communication sub-system 324, an alert 326, a keypad 328, a liquid crystal display (LCD) 330, which may include a touch sensitive surface, an LCD controller 332, a charge-coupled device (CCD) camera 334, a camera controller 336, and a global positioning system (GPS) sensor 338, and a power management module 340 operably coupled to a power storage unit, such as a battery 342. In various embodiments, the client node 202 may include another kind of display that does not provide a touch sensitive screen. In one embodiment, the DSP 302 communicates directly with the memory 304 without passing through the input/output interface ("Bus") 318.

In various embodiments, the DSP 302 or some other form of controller or central processing unit (CPU) operates to control the various components of the client node 202 in accordance with embedded software or firmware stored in memory 304 or stored in memory contained within the DSP 302 itself. In addition to the embedded software or firmware, the DSP 302 may execute other applications stored in the memory 304 or made available via information media such as portable data storage media like the removable memory card 320 or via wired or wireless network communications. The application software may comprise a compiled set of machine-readable instructions that configure the DSP 302 to provide the desired functionality, or the application software may be high-level software instructions to be processed by an interpreter or compiler to indirectly configure the DSP 302.

The antenna and front end unit 306 may be provided to convert between wireless signals and electrical signals, enabling the client node 202 to send and receive information from a cellular network or some other available wireless communications network or from a peer client node 202. In an embodiment, the antenna and front end unit 106 may include multiple antennas to support beam forming and/or multiple input multiple output (MIMO) operations. As is known to those skilled in the art, MIMO operations may provide spatial diversity, which can be used to overcome difficult channel conditions or to increase channel throughput. Likewise, the antenna and front-end unit 306 may include circuitry, for example, antenna tuning or impedance matching components, RF power amplifiers, or low noise amplifiers.

In various embodiments, the RF transceiver 308 provides frequency shifting, converting received RF signals to baseband and converting baseband transmit signals to RF. In some descriptions a radio transceiver or RF transceiver may be understood to include other signal processing functionality such as modulation/demodulation, coding/decoding, interleaving/deinterleaving, spreading/despreading, inverse fast Fourier transforming (IFFT)/fast Fourier transforming (FFT), cyclic prefix appending/removal, and other signal processing functions. For the purposes of clarity, the description here separates the description of this signal processing from the RF and/or radio stage and conceptually allocates that signal processing to the analog baseband processing unit 310 or the DSP 302 or other central processing unit. In some embodiments, the RF Transceiver 108, portions of the Antenna and Front End 306, and the analog base band processing unit 310 may be combined in one or more processing units and/or application specific integrated circuits (ASICs).

Note that in this diagram the radio access technology (RAT) RAT1 and RAT2 transceivers 354, 358, the IXRF 356, the IRSL 352 and Multi-RAT subsystem 350 are operably coupled to the RF transceiver 308 and analog baseband processing unit 310 and then also coupled to the antenna and front end 306 via the RF transceiver 308. As there may be multiple RAT transceivers, there will typically be multiple antennas or front ends 306 or RF transceivers 308, one for each RAT or band of operation.

The analog baseband processing unit 310 may provide various analog processing of inputs and outputs for the RF transceivers 308 and the speech interfaces (312, 314, 316). For example, the analog baseband processing unit 310 receives inputs from the microphone 312 and the headset 316 and provides outputs to the earpiece 314 and the headset 316. To that end, the analog baseband processing unit 310 may have ports for connecting to the built-in microphone 312 and the earpiece speaker 314 that enable the client node 202 to be used as a cell phone. The analog baseband processing unit 310 may further include a port for connecting to a headset or other hands-free microphone and speaker configuration. The analog baseband processing unit 310 may provide digital-to-analog conversion in one signal direction and analog-to-digital conversion in the opposing signal direction. In various embodiments, at least some of the functionality of the analog baseband processing unit 310 may be provided by digital processing components, for example by the DSP 302 or by other central processing units.

The DSP 302 may perform modulation/demodulation, coding/decoding, interleaving/deinterleaving, spreading/despreading, inverse fast Fourier transforming (IFFT)/fast Fourier transforming (FFT), cyclic prefix appending/removal, and other signal processing functions associated with wireless communications. In an embodiment, for example in a code division multiple access (CDMA) technology application, for a transmitter function the DSP 302 may perform modulation, coding, interleaving, and spreading, and for a receiver function the DSP 302 may perform despreading, deinterleaving, decoding, and demodulation. In another embodiment, for example in an orthogonal frequency division multiplex access (OFDMA) technology application, for the transmitter function the DSP 302 may perform modulation, coding, interleaving, inverse fast Fourier transforming, and cyclic prefix appending, and for a receiver function the DSP 302 may perform cyclic prefix removal, fast Fourier transforming, deinterleaving, decoding, and demodulation. In other wireless technology applications, yet other signal processing functions and combinations of signal processing functions may be performed by the DSP 302.

The DSP 302 may communicate with a wireless network via the analog baseband processing unit 310. In some embodiments, the communication may provide global computer network (e.g., Internet) connectivity, enabling a user to gain access to content on the global computer network and to send and receive e-mail or text messages. The input/output interface 318 interconnects the DSP 302 and various memories and interfaces. The memory 304 and the removable memory card 320 may provide software and data to configure the operation of the DSP 302. Among the interfaces may be the USB interface 322 and the short range wireless communication sub-system 324. The USB interface 322 may be used to charge the client node 202 and may also enable the client node 202 to function as a peripheral device to exchange information with a personal computer or other computer system. The short range wireless communication sub-system 324 may include an infrared port, a Bluetooth interface, an IEEE 802.11 compliant wireless interface, or any other short range wireless communication sub-system, which may enable the client node 202 to communicate wirelessly with other nearby client nodes and access nodes. The short-range wireless communication Sub-system 324 may also include suitable RF Transceiver, Antenna and Front End subsystems.

The input/output interface ("Bus") 318 may further connect the DSP 302 to the alert 326 that, when triggered, causes the client node 202 to provide a notice to the user, for example, by ringing, playing a melody, or vibrating. The alert 326 may serve as a mechanism for alerting the user to any of various events such as an incoming call, a new text message, and an appointment reminder by silently vibrating, or by playing a specific pre-assigned melody for a particular caller.

The keypad 328 couples to the DSP 302 via the I/O interface ("Bus") 318 to provide one mechanism for the user to make selections, enter information, and otherwise provide input to the client node 202. The keyboard 328 may be a full or reduced alphanumeric keyboard such as QWERTY, DVORAK, AZERTY and sequential types, or a traditional numeric keypad with alphabet letters associated with a telephone keypad. The input keys may likewise include a trackwheel, track pad, an exit or escape key, a trackball, and other navigational or functional keys, which may be inwardly depressed to provide further input function. Another input mechanism may be the LCD 330, which may include touch screen capability and also display text and/or graphics to the user. The LCD controller 332 couples the DSP 302 to the LCD 330.

The CCD camera 334, if equipped, enables the client node 202 to make digital pictures. The DSP 302 communicates with the CCD camera 334 via the camera controller 336. In another embodiment, a camera operating according to a technology other than Charge Coupled Device cameras may be employed. The GPS sensor 338 is coupled to the DSP 302 to decode global positioning system signals or other navigational signals, thereby enabling the client node 202 to determine its position. The GPS sensor 338 may be coupled to an antenna and front end (not shown) suitable for its band of operation. Various other peripherals may also be included to provide additional functions, such as radio and television reception.

In various embodiments, the client node (e.g., 202) comprises a first Radio Access Technology (RAT) transceiver 354 and a second RAT transceiver 358. As shown in FIG. 3, and described in greater detail herein, the RAT transceivers '1' 354 and '2' 358 are in turn coupled to a multi-RAT communications subsystem 350 by an Inter-RAT Supervisory Layer Module 352. In turn, the multi-RAT communications subsystem 350 is operably coupled to the Bus 318. Optionally, the respective radio protocol layers of the first Radio Access Technology (RAT) transceiver 354 and the second RAT transceiver 358 are operably coupled to one another through an Inter-RAT eXchange Function (IRXF) Module 356.

In various embodiments, the network node (e.g. 224) acting as a server comprises a first communication link corresponding to data to/from the first RAT and a second communication link corresponding to data to/from the second RAT.

Embodiments of the disclosure may make use of a flexible substrate, such as flexible PCB technology, to provide second (or additional) dimension of array gain for an antenna, such as an end-fire antenna. Flexible PCB material may be used in connection with 60 GHz integration into a small form-factor device. Accordingly, a physical folding of a 60 GHz routing may provide an advantage for placement of an antenna in such a device. In some embodiments, the 60 GHz spectrum may include one or more channels, bands or ranges. For example, a first range may be from 57.2 GHz-59.4 GHz, a second range may be from 59.4 GHz to 61.5 GHz, a third range may be from 61.5 GHz to 63.7 GHz, and a fourth range may be from 63.7 GHz to 65.8 GHz.

Given a device area (e.g., assuming that an area for an array is a limiting factor), by folding the flex antenna array, use of a third dimension may effectively double the number of antennas that could be fit in a fixed area. An increase in antenna gain (e.g., an increase on the order of 6 dB) may be obtained. As a result, performance of a millimeter (mm) Wave integrated radio may be increased relative to conventional implementations.

Turning now to FIGS. 4A-4E (collectively referred to as FIG. 4), a folded antenna array 400 in accordance with one or more embodiments is shown. For ease of illustration and convenience, x-y-z coordinate axes are shown as being superimposed on the array 400. The array 400 may include two antennas, 402*a* and 402*b*. The antennas 402*a* and 402*b* may be arrayed in one or more dimensions (e.g., the "z" dimension) by a fold (e.g., an approximate one-hundred eighty (180) degree fold) in a flexible PCB 404. In some embodiments, a first feed 406*a* associated with the antenna 402*a* and a second feed 406*b* associated with the antenna 402*b* may be (independently) coupled to a phased-array chip, allowing for flexibility in beam pattern steering. In some embodiments, the feeds may be coupled together to obtain a fixed beam pattern. In some other embodiments, signals from the same side of the PCB 404 may be routed to enable the array 400 to be fed or driven using a single phase array chip (not shown).

A pitch of the array 400 may be approximately the diameter of the fold in the PCB 404. In the example of FIG. 4, the pitch may be approximately 3 mm or 0.6 lambda (λ), where lambda corresponds to a signal wavelength. In some embodiments, a bend radius in the PCB 404 may correspond to a signal wavelength, a fraction of a signal wavelength, or a multiple of a signal wavelength. This pitch is known to those skilled in the art to determine such characteristics of the array 400 as gain and sidelobe leakage.

As reflected in FIG. 4, the antenna elements (e.g., antennas 402*a* and 402*b*) included in the folded antenna array 400 may have different orientations. The different orientations may, in turn, provide for a diversity of polarizations.

Figure 5:
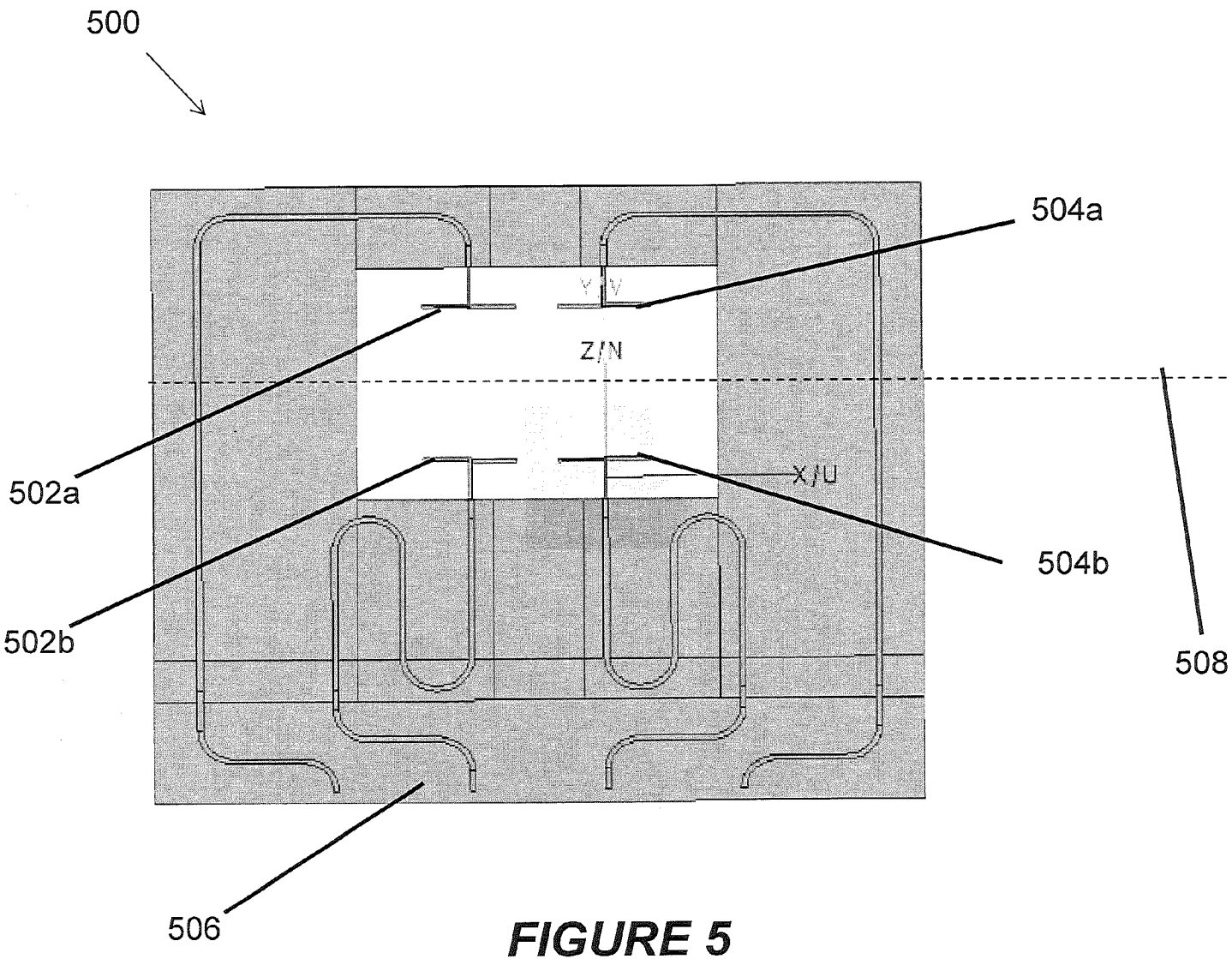
FIG. 5 illustrates a foldable substrate incorporating a two-by-two antenna array in accordance with one or more embodiments.

Turning now to FIG. 5, a two-by-two (2×2) array 500 is shown. The array 500 may include antennas 502*a*, 502*b*, 504*a*, and 504*b*. The antennas 502*a*, 502*b*, 504*a*, and 504*b* may be included on a flexible PCB 506. The PCB 506 may be folded about a fold-line 508. The 2×2 antenna array may be formed by antennas 502*a*, 502*b*, 504*a*, and 504*b* when the PCB 506 is folded about fold-line 508, similar to the structure described above in connection with FIG. 4. Antennas 502*a* and 504*a* may then reside directly above (e.g., in the z dimension) antennas 502*b* and 504*b* forming the 2×2 array in the z and x dimensions. The pitch of the array 500 in the z direction may be determined by the diameter of said fold.

Gain obtained from the array 500 shown in FIG. 5 may be at least partially a result of a contribution from the curved flex PCB 506 in front of one or more of the antennas 502*a*, 502*b*, 504*a*, and 504*b*. FIGS. 6 and 7 described below clarify this contribution in more detail.

Figure 6A:
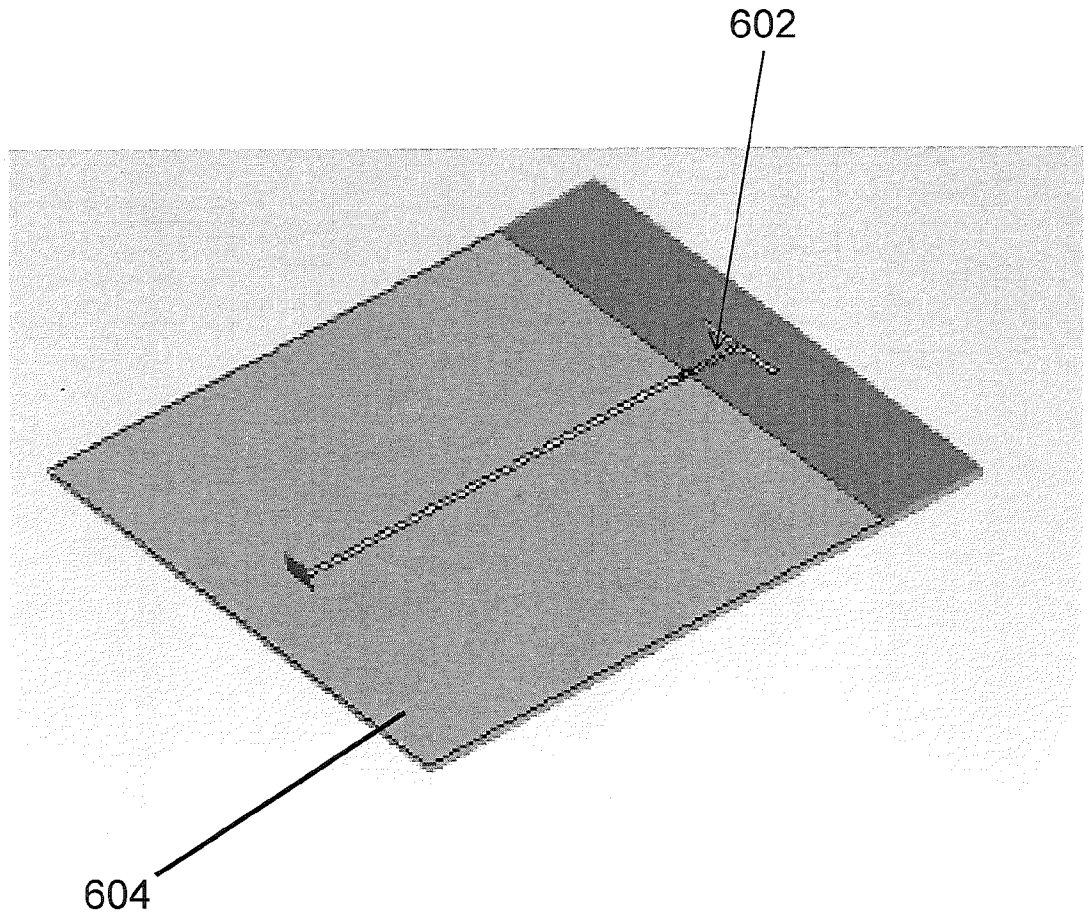
FIG. 6A illustrates an end-fire dipole antenna in accordance with one or more embodiments.
Figure 6B:
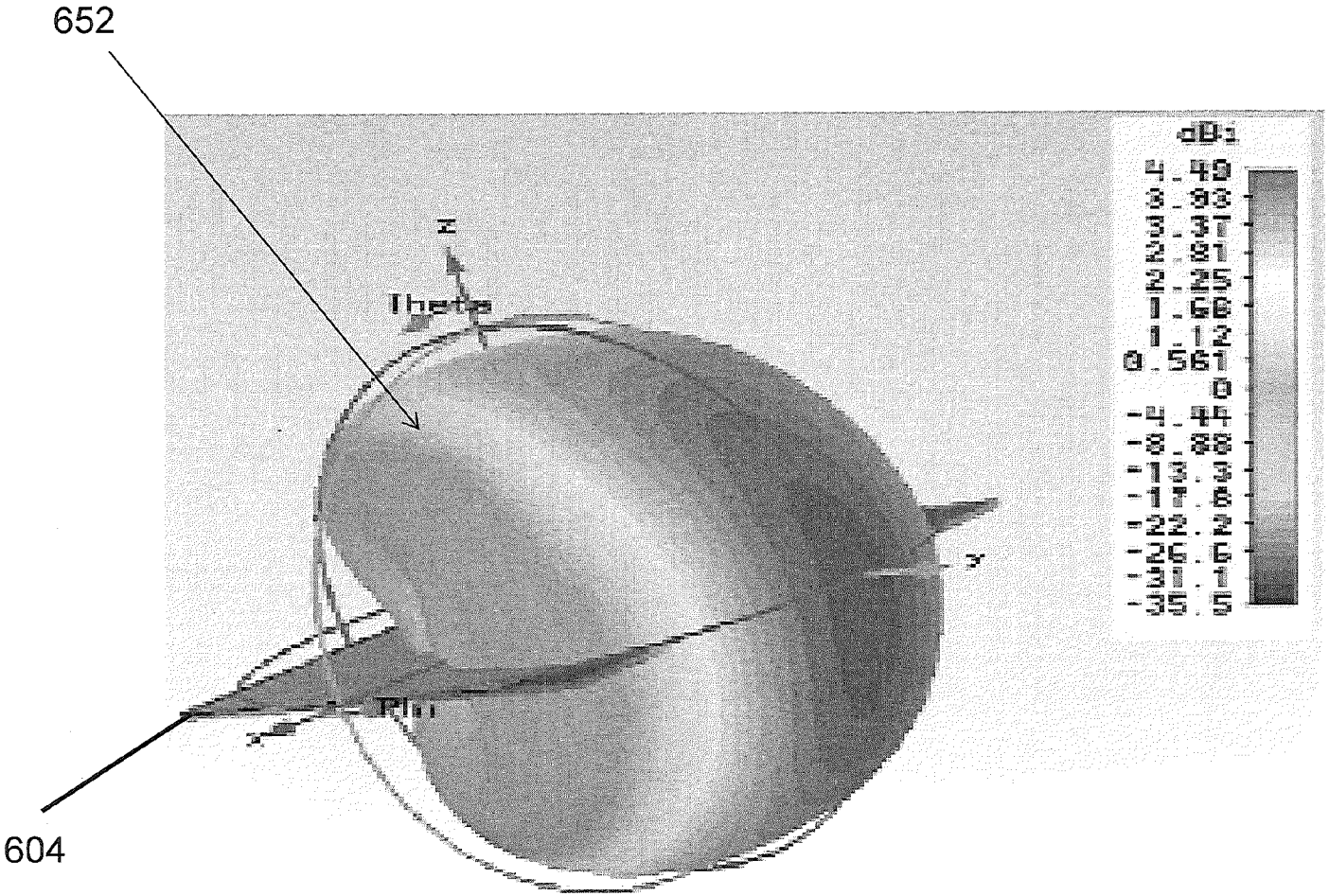
FIG. 6B illustrates a radiation pattern associated with the end-fire dipole antenna of FIG. 6A.

Turning now to FIGS. 6A-6B (collectively referred to as FIG. 6), an end-fire dipole antenna 602 is shown as being included on a PCB 604. An exemplary radiation pattern 652 resulting from use of the antenna 602/PCB 604 is also shown.

Figure 7A:
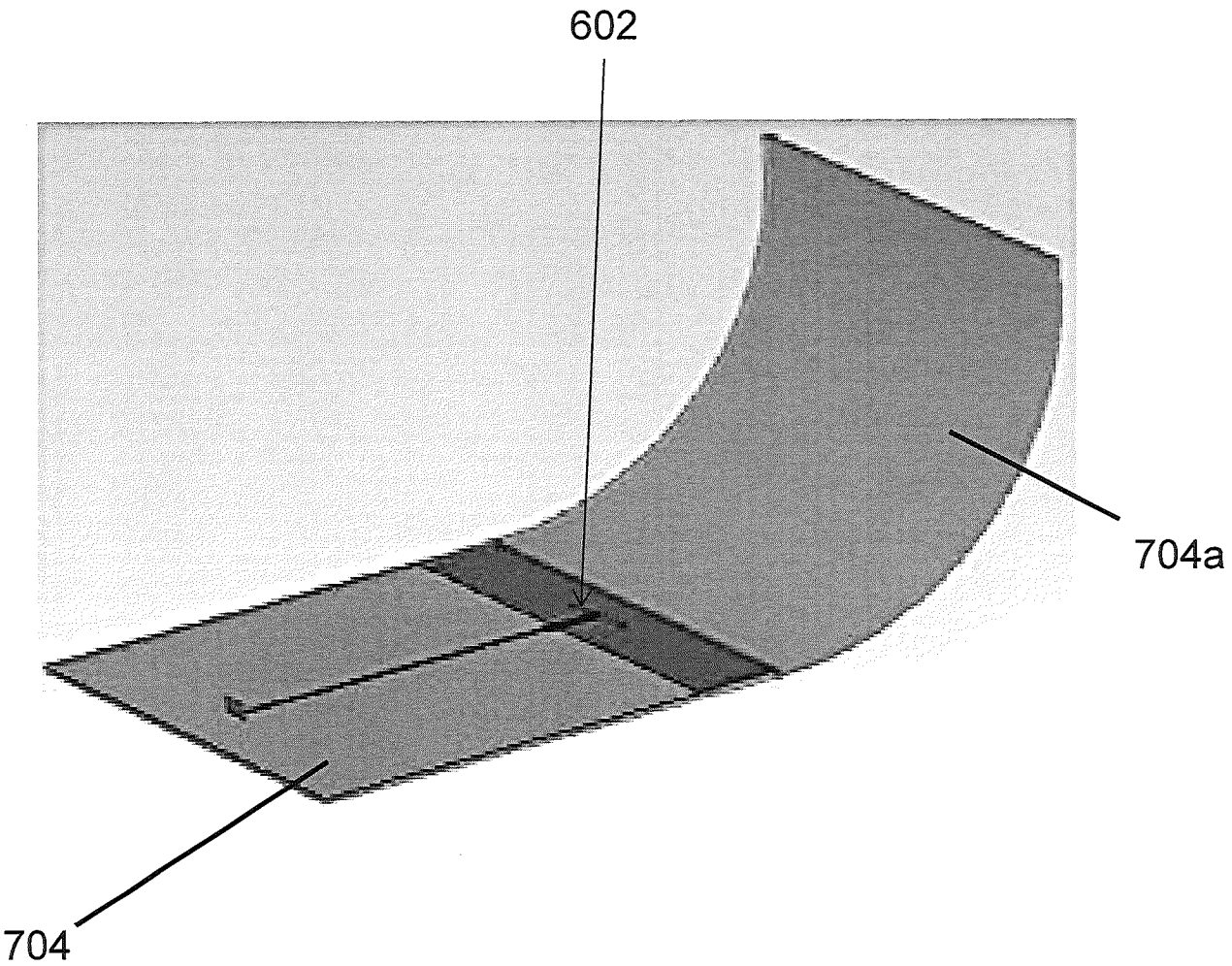
FIG. 7A illustrates an end-fire dipole antenna with a curved flex substrate in front of the antenna in accordance with one or more embodiments.
Figure 7B:
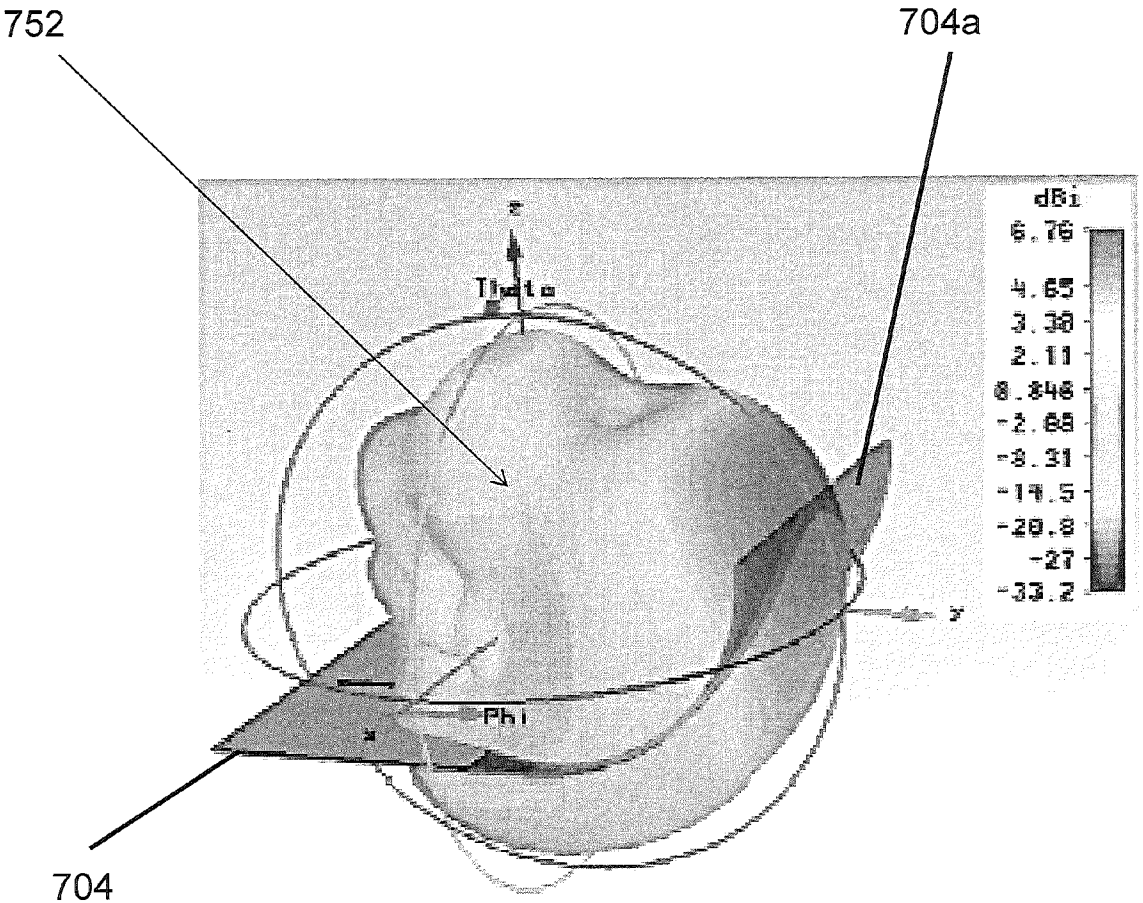
FIG. 7B illustrates a radiation pattern associated with the end-fire dipole antenna/substrate of FIG. 7A.

FIGS. 7A-7B (collectively referred to as FIG. 7) show the antenna 602 as being included on a PCB 704. The PCB 704 may be substantially similar to, or correspond to, the PCB 604 of FIG. 6. However, the PCB 704 may include a curved, flexible portion 704*a* in front of the antenna 602. In this example, the curved portion 704*a* does not fold back to overlie the antenna 602. The curved portion 704*a* can curve to 90 degrees in an example. In some examples, the curved portion curves less than 90 degrees. An exemplary radiation pattern 752 resulting from use of the antenna 602/PCB 704 is also shown.

A comparison of the form or shape of the radiation patterns 652 and 752 may be used to qualify the contribution made by the curved, flexible portion 704*a*. FIGS. 6B and 7B further include illustrative values for the gain (expressed in dBi (decibels referenced to isotropic radiator)), and so, the contribution of the curved, flexible portion 704*a* may be obtained on a quantified basis. As shown in FIG. 6B, the values for the radiation pattern 652 may range from approximately 4.49 dBi to −35.5 dBi. As shown in FIG. 7B, the values for the radiation pattern 752 may range from approximately 6.76 dBi to −33.2 dBi.

Turning now to FIGS. 8A-8D (collectively referred to as FIG. 8), antennas 802*a*-802*d* included on a PCB 804 are shown. The antennas 802*a*-802*d* may be organized as a linear array as shown in FIG. 8. While not shown in FIG. 8, each of the antennas 802*a*-802*d* may be coupled to a respective port of a phased array transceiver circuit, and each port may be associated with a respective signal phase and amplitude. By incorporating a shift in phase in, e.g., a second signal relative to a first signal, variation in an emergent beam or radiation pattern may be obtained as described further below.

Figure 8A:
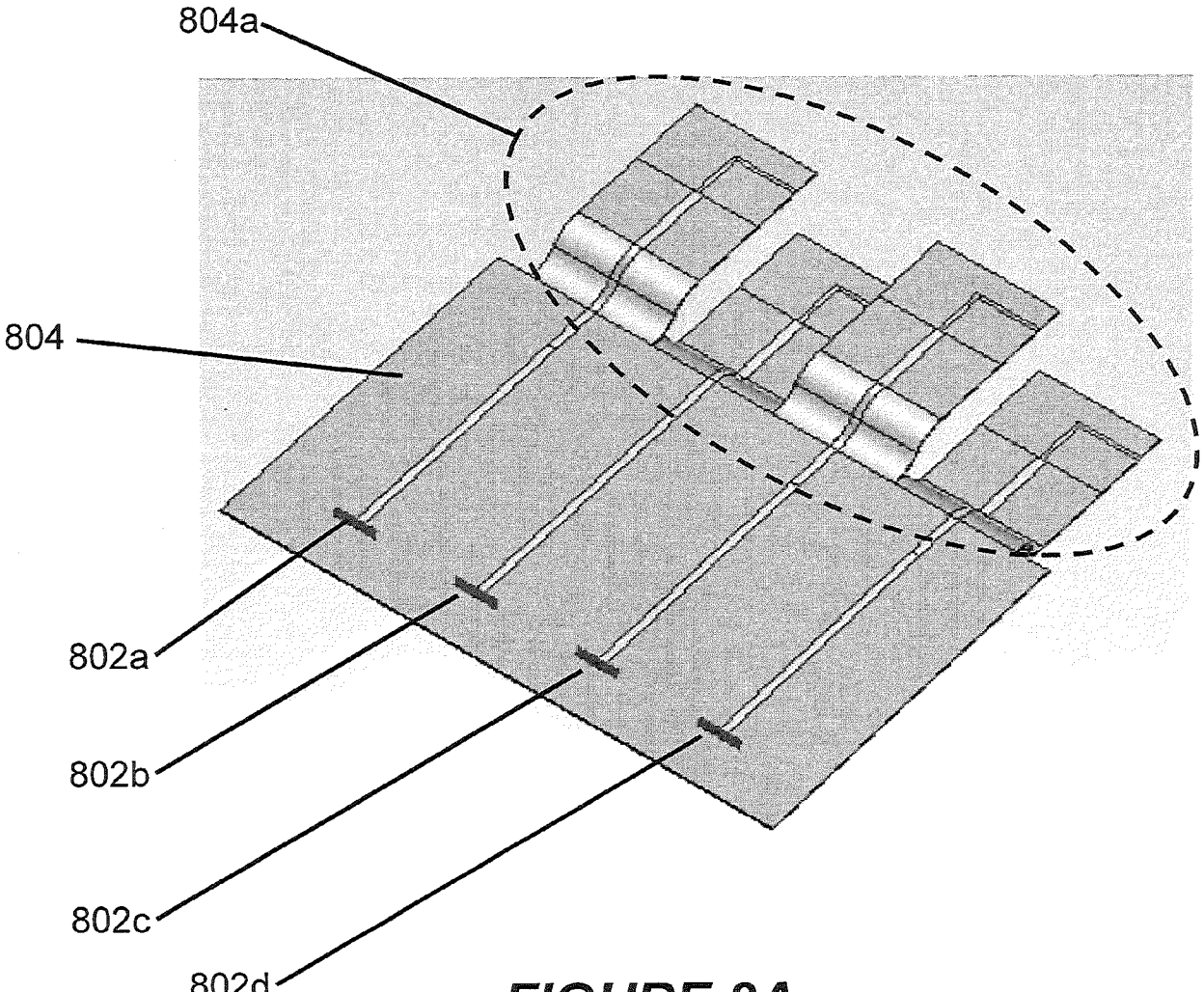
FIG. 8A illustrates a substrate with antennas and slits cut into the PCB in accordance with one or more embodiments.
Figure 8B:
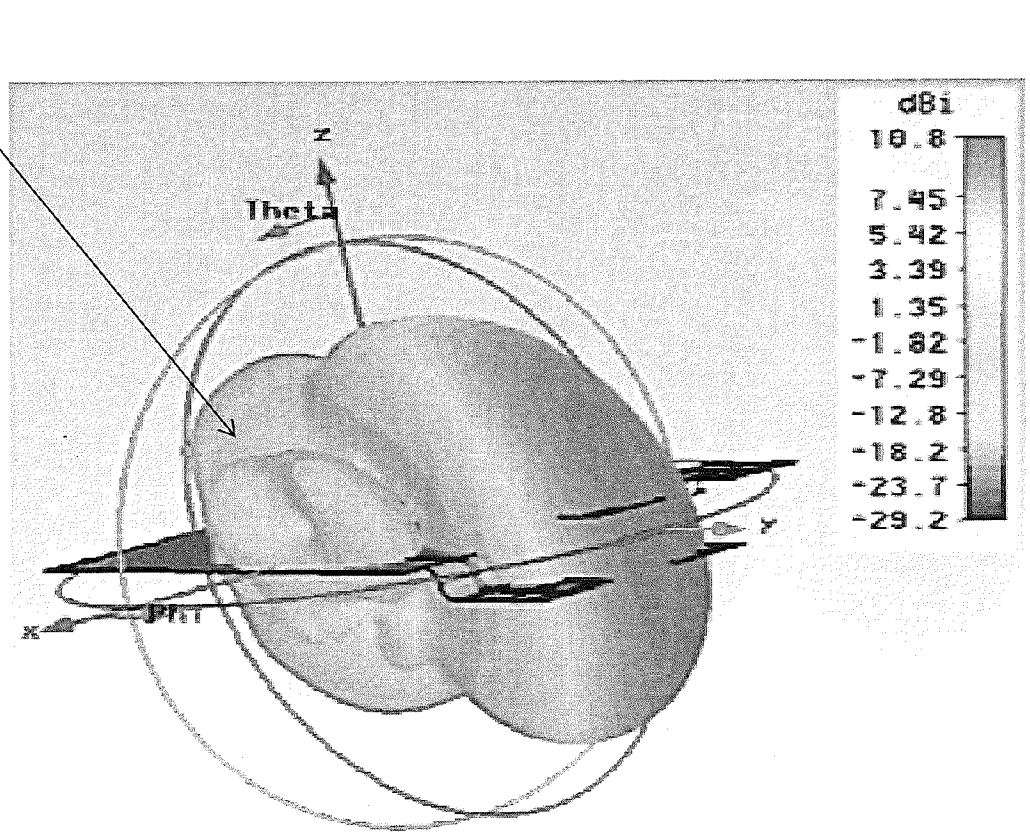
FIG. 8B illustrates a radiation pattern associated with the antennas/substrate of FIG. 8A.

One or more slits may be cut into the PCB 804 in-and-around the area or region denoted as 804*a*. One or more of the antennas 802*a*-802*d* may be displaced in one or more directions or dimensions (e.g., the "z" dimension) as a result of the slit(s) in order to effectuate a given beam steering or gain pattern. As shown in FIG. 8A, the portions of antennas 802*a*-802*d* are displaced relative to the remainder of the body of the substrate, PCB 804 and the feed portions of the antennas 802*a*-802*d*. As examples, a beam pattern 832 is shown for a phase vector [0, 0, 0, 0], a beam pattern 852 is shown for a phase vector [0, 90, 0, 90], and a beam pattern 872 is shown for a phase vector [90, 0, 90, 0]. In the preceding example, all amplitudes were held the same, although amplitude variation between the antennas 802*a*-802*d* can also be used to change the shape of the beam pattern.

The values for the phase vectors described above may be indicative of whether, and in what amount, a phase shift is introduced in a signal/port coupled to a given one of the antennas 802*a*-802*d*. A value of '0' may correspond to no phase shift, whereas any other value may correspond to a shift that is representative of the amount of the shift (in terms of, e.g., degrees). Thus, the value of '90' may correspond to a ninety degree phase shift relative to a reference value. In some instances, a phase shift imposed with respect to a given signal may correspond to an imposition of a time lag with respect to that signal.

The values for the phase vectors described above included four values, one value for each of the antennas 802*a*-802*d*. In embodiments where more or less than four antennas are included, a corresponding increase or decrease in the number of values included in a given phase vector may be provided.

Figure 8C:
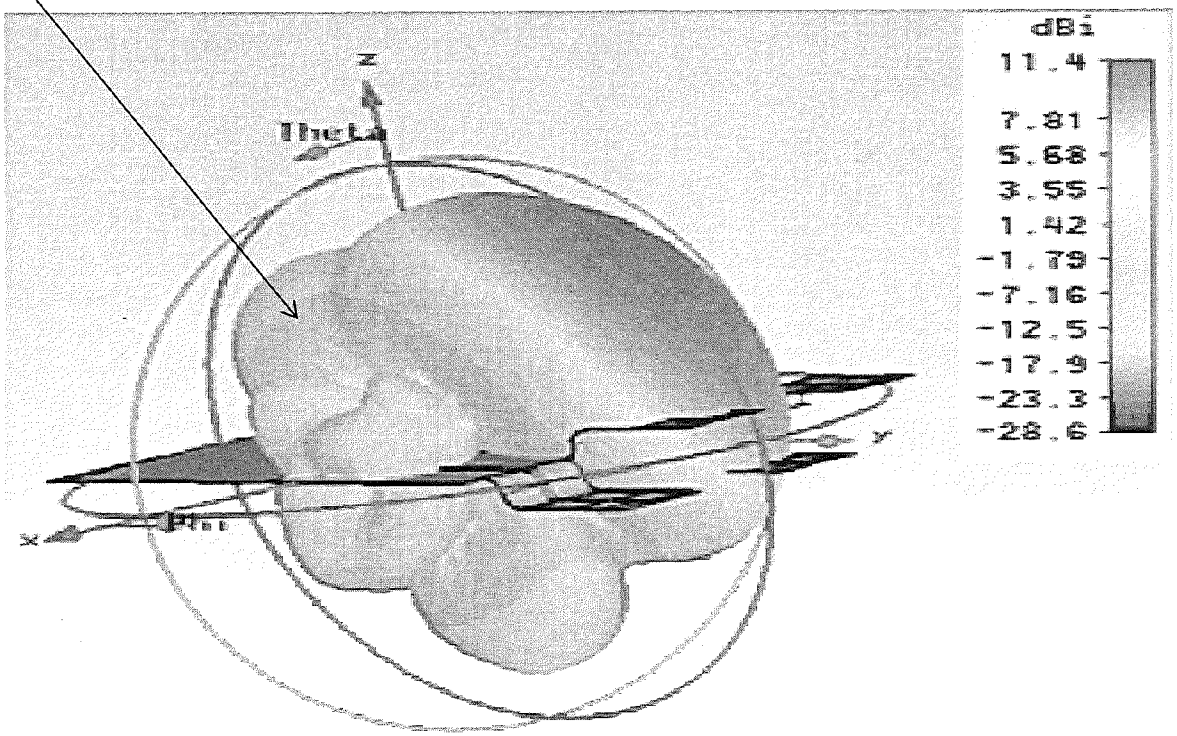
FIG. 8C illustrates a radiation pattern associated with the antennas/substrate of FIG. 8A.
Figure 8D:
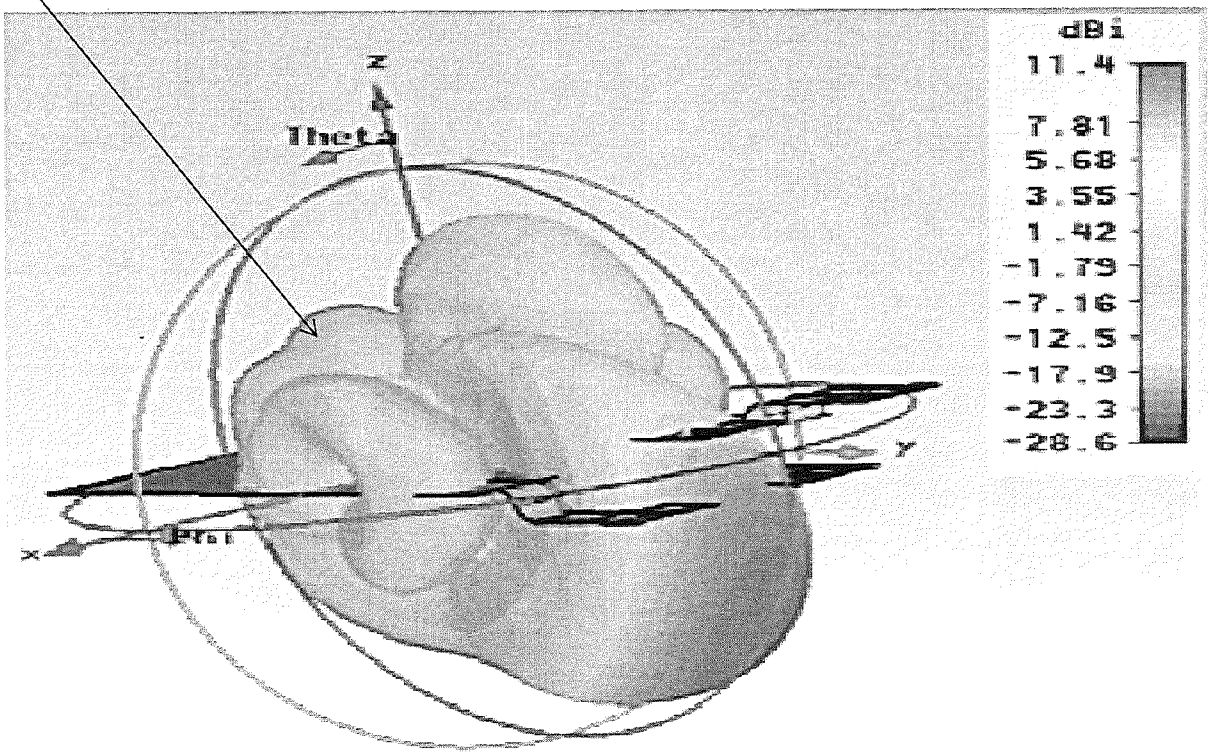
FIG. 8D illustrates a radiation pattern associated with the antennas/substrate of FIG. 8A.

The beam pattern 832 may correspond to "neutral" beam steering. The beam pattern 852 may correspond to beam steering "to the top" (or in the positive 'z' direction as shown in FIG. 8C). The beam pattern 872 may correspond to beam steering "to the bottom" (or in the negative 'z' direction as shown in FIG. 8D). The beam steering of FIGS. 8C and 8D may be based on one or more folds made in the PCB 804, such as folds in a vertical or z-direction.

Figure 9A:
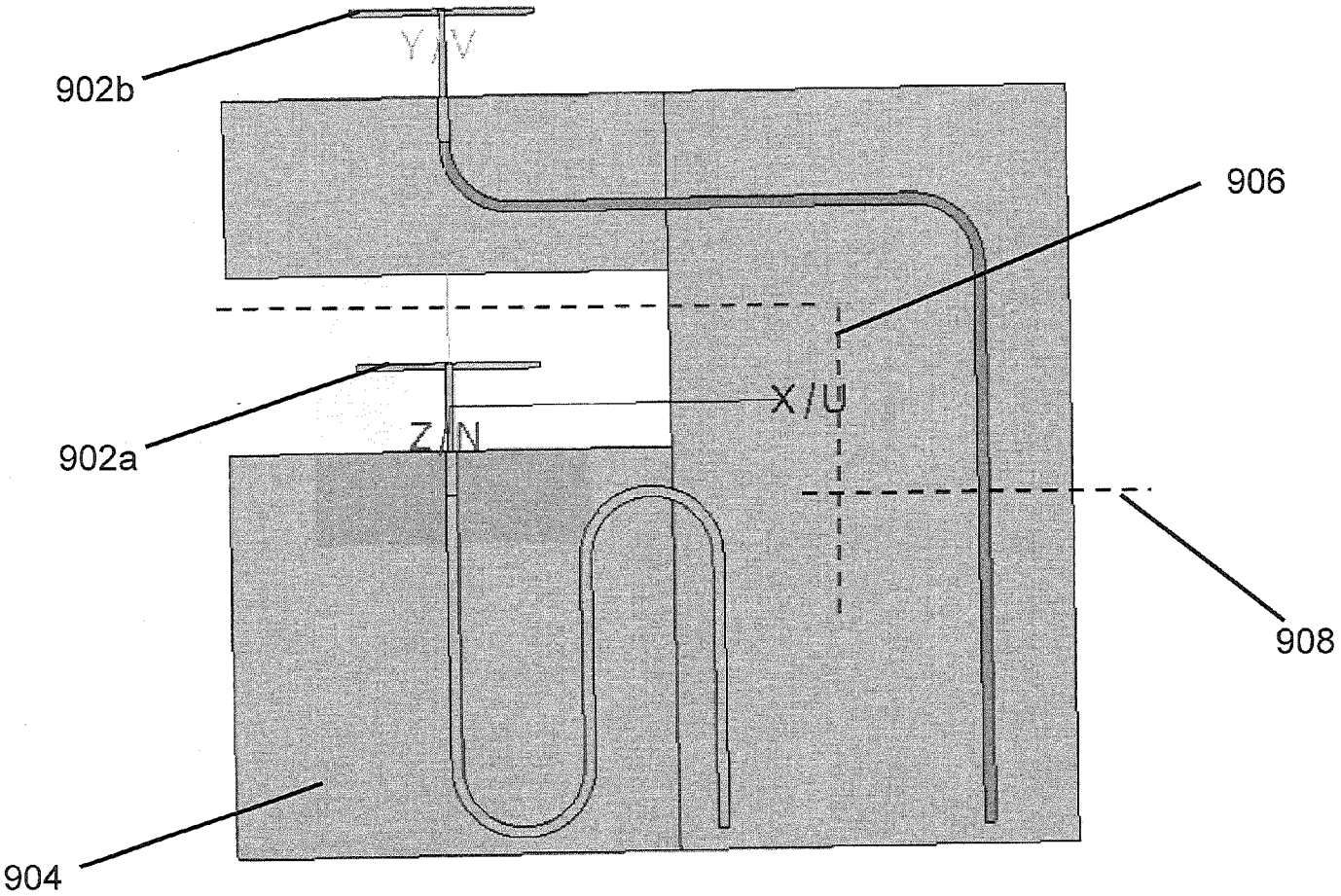
FIG. 9A illustrates a substrate including a one-by-two "slit" folded antenna array in accordance with one or more embodiments.
Figure 9B:
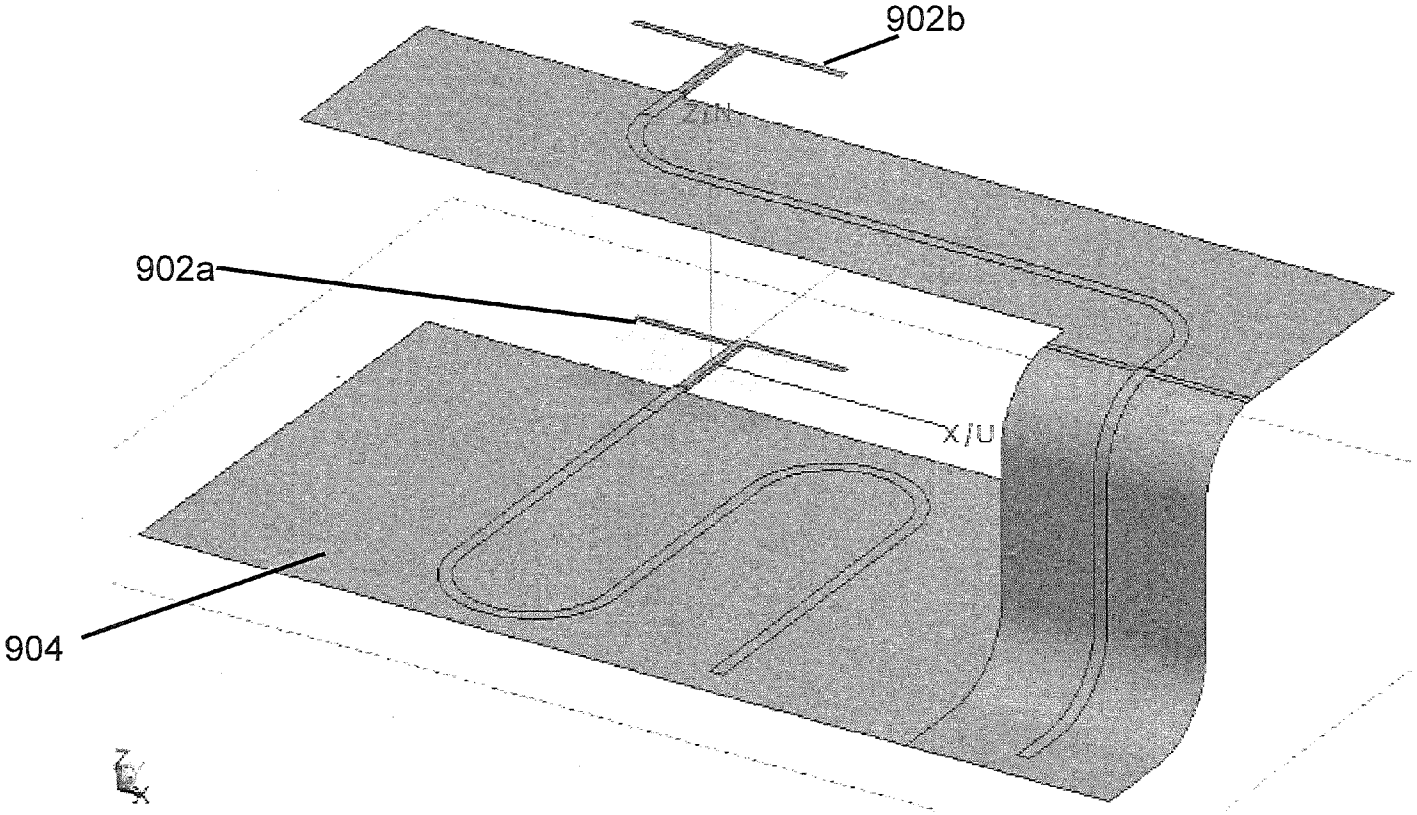
FIG. 9B illustrates a second, perspective view of the substrate of FIG. 9A after slitting and folding to produce the final array.

Turning now to FIGS. 9A-9B (collectively referred to as FIG. 9), antennas 902*a* and 902*b* are shown as being included on a PCB 904. The PCB 904 may be cut along the dotted line 906. The dotted line 906 may be oriented in at least two directions. For example, as shown in FIG. 9, the dotted line 906 is oriented in the 'x' and 'y' directions. A portion of the PCB 904 may be folded in, e.g., an "s" shape at the dotted line 908. Once the cut 906 and the fold 908 occur, the antennas 902*a* and 902*b* may lie on top of one another as shown in FIG. 9B. Thus, the architecture or design shown in FIG. 9 may be used to obtain a one-by-two (1×2) "slit" folded antenna array. In some embodiments, a spacer may be included to support the PCB 904 when in the orientation shown in FIG. 9B. The spacer may be fixed (e.g., glued) to the PCB 904 so that the fold is supported.

Figure 10:
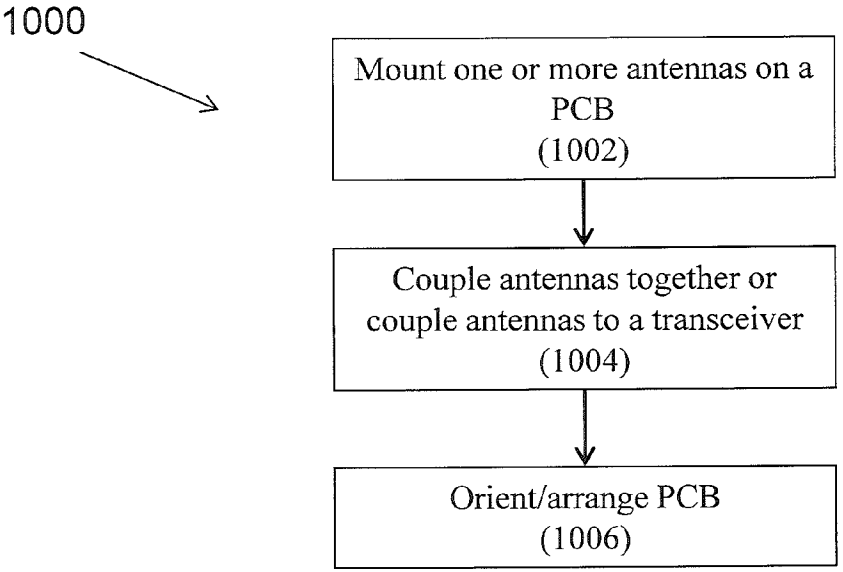
FIG. 10 illustrates a flow chart of a method in accordance with one or more embodiments.

Turning now to FIG. 10, a flow chart of an exemplary method 1000 in accordance with one or more embodiments is shown. The method 1000 may be used to fabricate a flexible substrate (e.g., a PCB) including one or more antennas. The method 1000 may be used to obtain a specified gain for an antenna or antenna array. The method 1000 may be used to obtain a PCB/antenna that is configured to support a radiation pattern or beam steering in one or more specified directions.

In block 1002, one or more antennas may be mounted on a PCB. For example, a first antenna (or first plurality of antenna) may be mounted on a first side of a foldable, flexible substrate and a second antenna (or second plurality of antenna) may be mounted on a second side of the substrate.

In block 1004, some of the antennas may be coupled together. For example, a feed may be implemented on a bent or folded portion of the PCB to couple the first and second antenna to one another. In some embodiments, one or more of the antennas may be coupled to a transceiver.

In block 1006, the PCB may be oriented or arranged. For example, as part of block 1006, a portion of the PCB may be folded and/or cut/slit.

As described herein, aspects of the disclosure may be used to design, fabricate, and use an antenna or an antenna array. The antenna may be associated with a computing device (e.g., a mobile phone). The antenna may be tuned in connection with one or more frequencies or frequency bands/ranges. The antenna may provide a gain that may be greater than a gain provided by conventional antennas of similar sizes or dimensions. The antenna and flexible substrate (e.g., PCB) technology described herein may be used to obtain a beam steering that was not previously available using, e.g., end-fire antennas. For example, folds in a flexible circuit material or circuit board may be used to obtain gain in a direction that is (substantially) perpendicular to a plane of the circuit material or circuit board.

Embodiments of the disclosure may be tied to one or more particular machines. For example, a flexible PCB technology may be used to increase a number of antennas or antenna arrays. In some embodiments, the flexible PCB technology may be used to fold a PCB along one or more fold-lines, potentially in one or more dimensions.

As described herein, in some embodiments various functions or acts may take place at a given location and/or in connection with the operation of one or more apparatuses, systems, or devices. For example, in some embodiments, a portion of a given function or act may be performed at a first device or location, and the remainder of the function or act may be performed at one or more additional devices or locations.

Embodiments of the disclosure may be implemented using one or more technologies. In some embodiments, an apparatus or system may include one or more processors, and memory storing instructions that, when executed by the one or more processors, cause the apparatus or system to perform one or more methodological acts as described herein. Various mechanical components known to those of skill in the art may be used in some embodiments.

Embodiments of the disclosure may be implemented as one or more apparatuses, systems, and/or methods. In some embodiments, instructions may be stored on one or more computer-readable media, such as a transitory and/or non-transitory computer-readable medium. The instructions, when executed, may cause an entity (e.g., an apparatus or system) to perform one or more methodological acts as described herein. In some embodiments, the functionality described herein may be implemented in hardware, software, firmware, or any combination thereof.

The particular embodiments disclosed above are illustrative only and should not be taken as limitations upon the present disclosure, as the disclosure may be modified and practiced in different but equivalent manners apparent to those skilled in the art having the benefit of the teachings herein. Accordingly, the foregoing description is not intended to limit the disclosure to the particular form set forth, but on the contrary, is intended to cover such alternatives, modifications and equivalents as may be included within the spirit and scope of the disclosure as defined by the appended claims so that those skilled in the art should understand that they can make various changes, substitutions and alterations without departing from the spirit and scope of the disclosure in its broadest form.

What is claimed is:

1. A device comprising:

a flexible substrate; and an end-fire dipole antenna array mounted on the flexible substrate, wherein the flexible substrate is configured to be oriented so that array gain is oriented in a desired direction away from a plane of the flexible substrate, and wherein the end-fire dipole atenna array comprises a plurality of antenna elements oriented to provide different polarizations.

2. The device of claim 1, wherein the flexible substrate comprises a printed circuit board.

3. The device of claim 1, wherein the end-fire dipole antenna array comprises two end-fire dipole antennas, and wherein the flexible substrate is configured to be folded by approximately one-hundred eighty degrees, and wherein the two end-fire dipole antennas are coupled to one another on a given side of the flexible substrate.

4. The device of claim 1, wherein the end-fire dipole antenna array comprises two end-fire dipole antennas, and wherein the flexible substrate is configured to be folded by approximately one-hundred eighty degrees, and wherein the two end-fire dipole antennas are configured to be driven by signals having at least one of different phases and different amplitudes.

5. The device of claim 1, wherein the end-fire dipole antenna array comprises an antenna element, and wherein the flexible substrate is configured to be curved in front of the antenna element.

6. The device of claim 1, wherein the end-fire dipole antenna array comprises a linear array that includes a plurality of end-fire dipole antennas, and wherein the flexible substrate is configured to be cut with a slit so that a first of the plurality of end-fire dipole antennas is offset from a second of the plurality of end-fire dipole antennas in a direction that is substantially perpendicular to the plane of the flexible substrate.

7. The device of claim 6, wherein the first of the plurality of end-fire dipole antennas is associated with a first signal port, and wherein the second of the plurality of end-fire dipole antennas is associated with a second signal port.

8. The device of claim 7, wherein the first signal port is configured to provide a first signal, and wherein the second signal port is configured to provide a second signal.

9. The device of claim 8, wherein the second signal is at least one of:

phase shifted relative to the first signal and scaled in amplitude relative to an amplitude of the first signal.

10. The device of claim 1, wherein the flexible substrate is configured with a slit in at least two directions to position the first antenna above the second antenna.

11. A method comprising:

mounting an end-fire dipole antenna array on a flexible substrate; and orienting the flexible substrate so that end-fire dipole antenna array gain is oriented in a desired direction away from a plane of the flexible substrate, wherein the end-fire dipole antenna array comprises a plurality of antenna elements oriented to provide different polarizations.

12. The method of claim 11, wherein the end-fire dipole antenna array comprises two end-fire dipole antennas, the method further comprising:

folding the flexible substrate by approximately one-hundred eighty degrees; and coupling the two end-fire dipole antennas to one another on a given side of the flexible substrate.

13. The method of claim 11, wherein the end-fire dipole antenna array comprises two end-fire dipole antennas, the method further comprising:

folding the flexible substrate by approximately one-hundred eighty degrees; and driving the two end-fire dipole antennas using signals having at least one of different phases and different amplitudes.

14. The method of claim 11, wherein the end-fire dipole antenna array comprises an antenna element, the method further comprising:

curving the flexible substrate in front of the antenna element in order to steer a radiation pattern.

15. The method of claim 11, wherein the end-fire dipole antenna array comprises a linear array that includes a plurality of end-fire dipole antennas, the method further comprising:

cutting the flexible substrate with a slit so that a first of the plurality of end-fire dipole antennas is offset from a second of the plurality of end-fire dipole antennas in a direction that is substantially perpendicular to the plane of the flexible substrate.

16. The method of claim 15, wherein the first of the plurality of end-fire dipole antennas is associated with a first signal port, and wherein the second of the plurality of end-fire dipole antennas is associated with a second signal port.

17. The method of claim 16, wherein the first signal port is configured to provide a first signal, and wherein the second signal port is configured to provide a second signal.

18. The method of claim 17, wherein the second signal is at least one of:

phase shifted relative to the first signal and scaled in terms of amplitude relative to an amplitude of the first signal.

19. The method of claim 11, wherein the end-fire dipole antenna array comprises a first end-fire dipole antenna and a second end-fire dipole antenna, the method further comprising:

cutting the flexible substrate with a slit in at least two directions; and folding the flexible substrate so that the first antenna is above the second antenna.

20. An antenna array comprising:

a foldable, flex substrate having a first side, a second side, and a bent connection connecting the first side and the second side;

a first plurality of end-fire dipole antenna mounted to the first side;

a second plurality of end-fire dipole antenna mounted to the second side; and a feed, at least on the bent connection, connected to both the first and second pluralities of end-fire dipole antenna.

21. The antenna array of claim 20, wherein the antenna array is used in millimeter radio.

* * * * *